US009044872B2

(12) United States Patent
Pryor et al.

(10) Patent No.: US 9,044,872 B2
(45) Date of Patent: Jun. 2, 2015

(54) INTERLEAVER SYSTEM FOR HIGH SPEED SLICING MACHINE

(75) Inventors: Glen F. Pryor, Manhattan, IL (US); Wayne H. Webster, Wilmington, IL (US)

(73) Assignee: FORMAX, INC., Mokena, IL (US)

( * ) Notice: Subject to any disclaimer, the term of this patent is extended or adjusted under 35 U.S.C. 154(b) by 919 days.

(21) Appl. No.: 13/214,748

(22) Filed: Aug. 22, 2011

(65) Prior Publication Data

US 2012/0073249 A1 Mar. 29, 2012

Related U.S. Application Data

(60) Provisional application No. 61/375,517, filed on Aug. 20, 2010.

(51) Int. Cl.

| | |
|---|---|
| ***B65B 25/08*** | (2006.01) |
| ***B65B 61/20*** | (2006.01) |
| ***B26D 7/32*** | (2006.01) |
| ***B65B 41/12*** | (2006.01) |
| ***B65B 61/06*** | (2006.01) |
| *B26D 5/00* | (2006.01) |

(52) U.S. Cl.

CPC ..... *B26D 7/325* (2013.01); *B65B 61/207* (2013.01); *B26D 5/00* (2013.01); *B65B 25/08* (2013.01); *B65B 41/12* (2013.01); *B65B 61/06* (2013.01); *B26D 2210/02* (2013.01)

(58) Field of Classification Search

CPC ..... B65B 25/08; B65B 61/207; B26D 7/325; B26D 2210/02

USPC ..... 53/157, 513–519; 426/420; 242/418.1, 242/421.5, 422.4

See application file for complete search history.

(56) References Cited

U.S. PATENT DOCUMENTS

| | | | | |
|---|---|---|---|---|
| 2,635,965 | A * | 4/1953 | Hensgen et al. | 53/157 |
| 2,760,871 | A * | 8/1956 | Hensgen et al. | 53/157 |
| 2,781,272 | A * | 2/1957 | Rudnik et al. | 53/157 |

(Continued)

FOREIGN PATENT DOCUMENTS

| | | | | |
|---|---|---|---|---|
| DE | 4125539 | A1 * | 2/1993 | B65B 25/08 |
| EP | 0 251 337 | A2 | 1/1988 | |
| WO | 2007/050677 | A2 | 5/2007 | |

OTHER PUBLICATIONS

Search Report for European Application No. EP 11 81 8888 dated Feb. 11, 2015, 6 pages.

*Primary Examiner* — Stephen F Gerrity

(74) *Attorney, Agent, or Firm* — Klintworth & Rozenblat IP LLC

(57) ABSTRACT

A sheet interleaver is provided for a slicing machine that includes a slicing plane for slicing an elongated food product and a sheet of web material beneath the elongated product. The interleaver includes a supply of web material, a drawing station, and a feed station. A tensioning station is disposed between the supply of web material and the drawing station to maintain the tension of the web material at a pre-determined tension. A web accumulation station is between the drawing station and the feed station to provide a slackened length of web material within an acceptable range of slack between the drawing station and the feed station. The supply of web material is disposed on a spool which rotates about a cylindrical shaft. The cylindrical shaft has a braking mechanism which protrudes from the shaft to generate a frictional force against the spool.

9 Claims, 26 Drawing Sheets

(56) References Cited

U.S. PATENT DOCUMENTS

| | | | | | |
|---|---|---|---|---|---|
| 2,877,120 | A | * | 3/1959 | Bush | 53/157 |
| 2,900,143 | A | * | 8/1959 | Bandy et al. | 242/418.1 |
| 3,312,415 | A | * | 4/1967 | Jeans | 242/421.5 |
| 3,481,746 | A | | 12/1969 | Clemens | |
| 3,537,497 | A | * | 11/1970 | Dickow et al. | 83/13 |
| 3,718,221 | A | | 2/1973 | Visser | |
| 3,772,040 | A | * | 11/1973 | Benson et al. | 53/157 |
| 3,782,649 | A | * | 1/1974 | Frederick et al. | 242/418.1 |
| 3,782,653 | A | | 1/1974 | Jones | |
| 3,826,438 | A | * | 7/1974 | Stanley | 242/421.5 |
| 3,918,561 | A | | 11/1975 | Isacsson | |
| 4,000,865 | A | | 1/1977 | Gaskins | |
| 4,213,576 | A | * | 7/1980 | Magnuson | 242/528 |
| 4,447,016 | A | * | 5/1984 | Enberg et al. | 242/413.3 |
| 4,583,435 | A | | 4/1986 | Fessler | |
| 4,611,799 | A | * | 9/1986 | Nuttin | 242/418.1 |
| 5,170,956 | A | * | 12/1992 | McTaggart | 242/422.4 |
| 5,426,917 | A | * | 6/1995 | Daane et al. | 53/435 |
| 5,501,412 | A | * | 3/1996 | McAleavey | 242/418.1 |
| 5,505,401 | A | * | 4/1996 | Lamothe | 242/412.2 |
| 5,628,237 | A | | 5/1997 | Lindee et al. | |
| 5,649,463 | A | | 7/1997 | Lindee et al. | |
| 5,704,265 | A | | 1/1998 | Johnson et al. | |
| 5,707,024 | A | * | 1/1998 | Mellquist et al. | 242/418.1 |
| 5,724,874 | A | | 3/1998 | Lindee et al. | |
| 6,095,391 | A | * | 8/2000 | Fiske et al. | 242/418.1 |
| 6,237,585 | B1 | | 5/2001 | Oishi et al. | |
| 6,260,783 | B1 | | 7/2001 | Realff et al. | |
| 6,484,615 | B2 | | 11/2002 | Lindee | |
| 6,623,412 | B2 | * | 9/2003 | Terranova et al. | 242/418.1 |
| 6,752,056 | B1 | | 6/2004 | Weber | |
| 6,834,823 | B2 | * | 12/2004 | Nauta et al. | 242/418.1 |
| 2003/0052148 | A1 | | 3/2003 | Rajala et al. | |
| 2003/0145700 | A1 | | 8/2003 | Lindee | |
| 2007/0256902 | A1 | | 11/2007 | Niehorster et al. | |
| 2008/0250944 | A1 | | 10/2008 | Pryor et al. | |
| 2009/0188363 | A1 | | 7/2009 | Lindee et al. | |
| 2011/0081225 | A1 | * | 4/2011 | Ward et al. | 414/789.5 |

* cited by examiner

INTERLEAVER SYSTEM FOR HIGH SPEED SLICING MACHINE

This application claims the benefit of U.S. Provisional Application 61/375,517 filed on Aug. 20, 2010.

FIELD OF THE INVENTION

This invention relates in general to food slicing apparatus, and more particularly to the slicing of foods with interleaving sheets.

BACKGROUND OF THE INVENTION

Food loaves come in a variety of shapes (round, square, rectangular, oval, etc.), cross-sections, and lengths. Such loaves are made from various comestibles, such as meat, cheese, etc. Most loaves are provided to an intermediate processor who slices and packages the products in groups for retail.

A variety of machines have been developed to slice such loaves. Such machines include the FX 180®, FX Plus®, PowerMax3000™ and Powermax4000™ slicing machines available from Formax, Inc., of Mokena, Ill., USA. The FX 180® and the FX Plus®, PowerMax3000™ and Powermax4000™ machines are high speed food loaf slicing machines that slice one, two, or more food loaves simultaneously using one cyclically driven slicing blade. Independent loaf feed drives are provided so that slices cut from one loaf may vary in thickness from slices cut from the other loaf. The machines include a slicing station that is enclosed by a housing, except for a limited slicing opening. The slicing blade is disposed in the slicing station and a drive rotates the slicing blade at a predetermined cyclical rate on a cutting path through a slicing range that intersects the food loaves as they are fed into the slicing station.

In the foregoing machines, the food loaf slices are received in groups of predetermined weight on a receiving conveyor that is disposed adjacent the slicing blade. The receiving conveyor receives the slices as they are cut by the slicing blade. In many instances, neatly aligned stacked groups are preferred and, as such, the sliced product is stacked on the receiving conveyor before being transferred from the machine. In other instances, the groups are shingled so that a purchaser can see a part of every slice through a transparent package. In these other instances, conveyor belts of the receiving conveyor are gradually moved during the slicing process to separate the slices.

Paper interleaving mechanisms used in conjunction with cutting machines are disclosed in U.S. Pat. Nos. 6,752,056 and 4,583,435. According to these patents, slabs of product such as cheese are oriented angularly with respect to a horizontal conveyor and are fed downwardly into a slicing plane defined by a moving slicing blade. A roll of web material such as paper is arranged beneath the slab and has a length of web continuously fed toward and beneath a cut face of the slab such that when the cutting blade slices a slice from the slab the cutting blade simultaneously slices off a leading end portion of the web, forming a sheet. The sheet with the overlying slice fall to the conveyor or onto a previously cut slice already deposited onto the conveyor to form a stack. The web is continuously fed such that successive sheets are interleaved with successive cut slices.

Both of these patents described the use of air jets to assist in coupling the lead end portion of the web to the front face of the slice to be cut. Both of the patents incorporate driven rollers to dispense the web from a roll of web material.

The present inventors have recognized that it would be desirable to improve the reliability of the placement of sheets for interleaving with product slices, particularly for high-speed slicing operations. Reliability of the placement sheets for interleaving with product slices is improved using a feedback loop system to regulate the degree of tension in the interleave web with more precision.

The present inventors have recognized that the incorporation of a frictional braking system within the feedback loop system improves the control of the speed of the dispensing reel.

The present inventors have recognized the need for a more efficient arrangement of apparatus components when more than one loaf is being sliced. A coaxial arrangement for a slicing machine that slices two or more side-by-side loaves allows for the slicing machine to take up less space and provide easier access to machine components.

SUMMARY OF THE INVENTION

The present invention provides an improved web dispensing arrangement for interleaving sheets with sliced food product. The invention pertains to high speed slicing machines wherein web material is dispensed in synchronism with the slicing operation and the leading end portion of the web material is arranged on a downstream side of the cut face of the product. The remaining portion of the web material is arranged on an opposite side of the cutting plane than the leading end portion such that the slicing blade slices not only the product, but the leading end portion of the web material. The cut leading end portion of the web material forms a sheet that fronts the cut slice and both fall to a conveyor or onto a stack previously deposited on the conveyor. Thus a stack of interleaved slices and sheets can be formed and conveyed away for packaging.

According to one aspect of the invention, a sheet interleaver system is provided for a slicing machine that includes a slicing plane for slicing an elongated food product and a sheet from web material beneath the elongated product. The interleaver system includes a supply of web material, a tension control station, a drawing station, an accumulation station, a feed station, and a controller.

The drawing station has a first driver which draws the web material from the supply through the tension control station. The feed station has a second driver for receiving the web material from the drawing station via the accumulation station and drives the web material through a cutting nip into the slicing plane. The controller is in signal communication with at least one of the first driver and a sensor that determines the length of web material within the accumulation station. The supply of web material comprises a braking mechanism which is also in signal communication with the controller.

The controller is in signal communication with the first driver to maintain the length of web material within the accumulation station within a range of length, as well as with the braking mechanism to maintain the tension in the web between the supply and the drawing station to a pre-selected tension value.

A slackened supply of web material is available in the accumulation station and its length is monitored by the sensor which is in signal-communication with the controller. The speed of the first drive is adjusted to maintain the slackened length within a preselected range.

The tension control station is provided between the supply of web material and the drawing station such that tension of the web material between the drawing station and the web supply can be controlled. Tension of the web material in the tension control station is controlled by use of a dancer roller that exerts a pre-selected force on the web throughout a range of travel of the dancer roller.

The tension control station comprises a series of rollers and the dancer roller which adjusts in position over a range of movement while providing the desired degree of tension between the web supply and the drawing station. The dancer roller is biased by a positioning mechanism which is in signal communication with the controller. The controller is also in signal communication with the braking mechanism to form a continuous feed back loop system for adjusting the position of the dancer roller and for adjusting the braking mechanism.

The braking mechanism can be a frictional braking mechanism where brake pads mounted to braking blocks are used to generate a source of friction. Braking blocks are connected to an actuating mechanism which causes braking blocks to extend and retract, thereby allowing the brake pads to come in and out of contact, respectively, with the reel of web material.

The position of the dancer roller is controlled by movement of a pair of levers which pivots about a pivot attachment. A lever arm is clamped and pinned to the pivot attachment to rotate therewith. The lever arm is ratably attached to an extendable rod of a position sensing pneumatic actuator. Controlled pneumatic pressure delivered to the actuator extends an extending force on the actuator rod, which in turn moves the lever arm. Movement of the lever arm causes the pivot attachment, and accordingly the dancer roller, to move. The constant force form the actuator causes a the dancer roller to provide a constant tension on the web.

The feed station can comprise a drive roller and a nip plate device with the web material fed therebetween. The drive roller rotates to drive an extended end portion of the web material through a cutting nip. An upper frame member rotatably mounts the drive roller. A lower frame member mounts the nip plate device. The lower frame member is pivotally mounted to the upper frame member. Pivoting the lower frame member away from the upper frame member opens the cutting nip and the space between the drive roller and the nip plate device to allow the web material to be threaded between the drive roller and the nip plate device, and through the cutting nip.

The drive roller is driven by a servomotor. The servomotor drives the web material in a closely controlled and precise manner. The servomotor can be controlled to interleave a sheet between every cut slice or only interleave sheets between some cut slices but not others, such as between every other cut slice. Alternatively, the servomotor can be controlled to interleave a sheet between every cut slice for a number of slices and then change to interleave sheets less frequently, such as allowing a group of slices to be accumulated without sheets and then interleaving the next group of slices with sheets. The servomotor and associated control allows a great flexibility on the pre-programmed selection of interleaving slices without manual intervention.

As a further aspect of the invention a pressurized air dispenser is provided that is configured to direct an air stream onto a side of the slackened length to maintain a tension on the slackened length of web material in the accumulation station.

According to another aspect of the invention, in slicing machines where side-by side loaves of food product are processed, actuating mechanisms can be arranged coaxially to allow for a more efficient use of space.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENT

Figure 1:
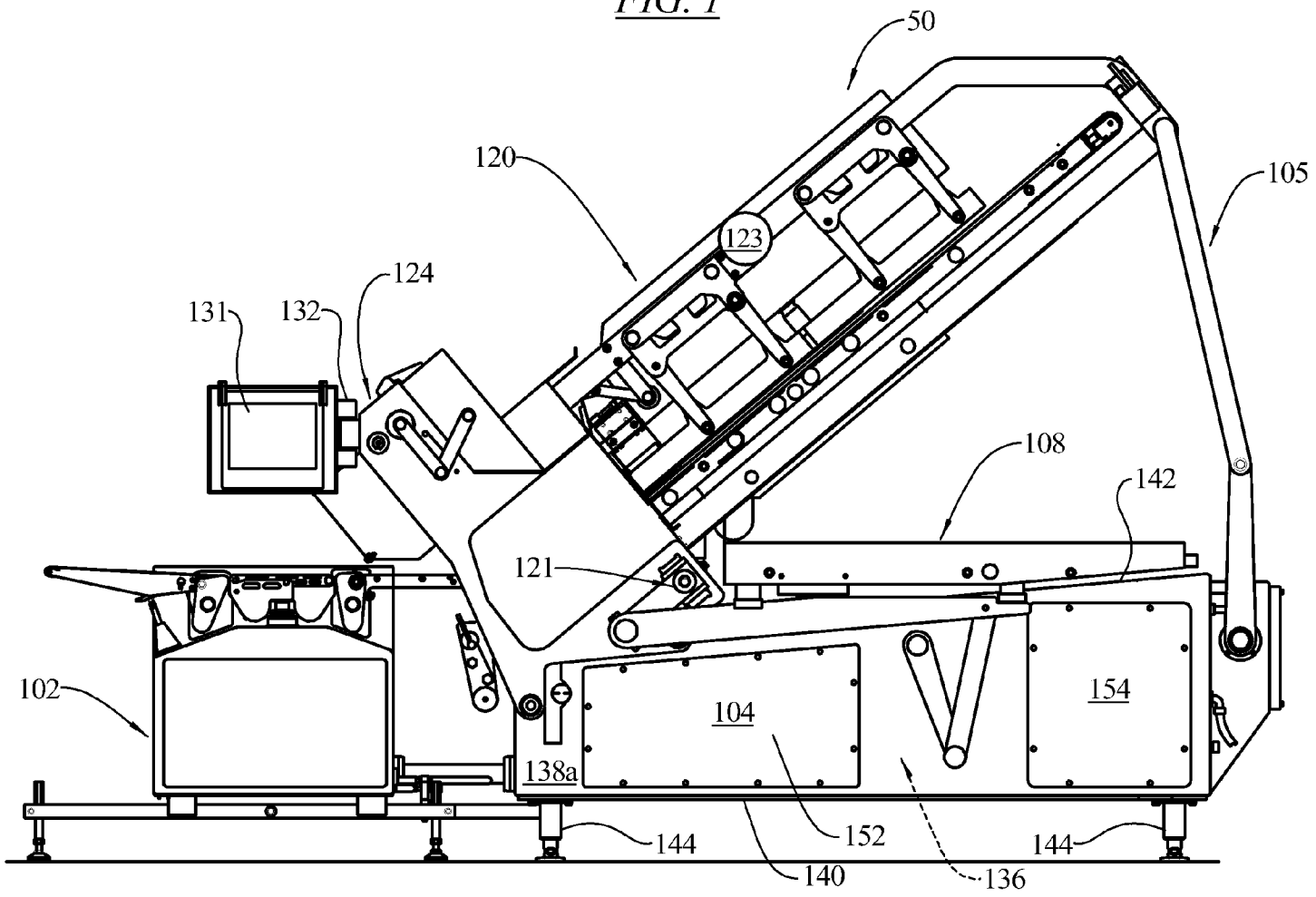
FIG. 1 is a side view of a high-speed slicing apparatus suitable for incorporation of the sheet interleaving mechanism of the present invention

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates one embodiment of a food loaf slicing machine 50 that may incorporate the sheet interleaver of the present invention. The slicing machine can be a high speed slicing machine such as disclosed in U.S. Pat. Nos. 6,484,615; 5,628,237; 5,649,463; 5,704,265; 5,724,874; and U.S. Published Patent Application US 2009/0188363 A1, all herein incorporated by reference, to the extent that the references are not contrary to the present specification, or as commercially available as a FX 180®, FX Plus®, PowerMax3000™ and Powermax4000™ slicing machine and/or system available from Formax, Inc. of Mokena, Ill., USA.

The slicing apparatus 50 includes a base section 104, a collapsible frame 105, an automatic food article loading apparatus 108 that receives food articles to-be-sliced, a food article feed apparatus 120, a food article feed elevation adjusting apparatus 121, a laser safety guard system 123, and a slicing head apparatus 124. The slicing apparatus also includes a computer display touch screen 131 that is pivotally mounted on and supported by a support 132.

The base section 104 includes a compartment 136 having side walls 138*a*, a bottom wall 140, and an inclined top wall 142. The apparatus 100 is supported on four adjustable feet 144. The compartment 136 has a tapered side profile from back to front wherein the top wall 142 slants down from back to front. The slanted orientation of the top wall 142 ensures water drainage off the top of the compartment 136.

The compartment 136 includes near side doors 152,154, far side doors, and a rear door that permit access into the compartment or to modules normally within the compartment 136. The compartment 136 typically affords an enclosure for a computer, motor control equipment, a low voltage supply, and a high voltage supply and other mechanisms as described below. The compartment may also include a pneumatic supply or a hydraulic supply, or both (not shown).

The slicing machine 50 includes a stacking conveyor or jump conveyor 130 (FIG. 2) beneath the slicing head apparatus 124, particularly beneath a rotating slicing blade 100. The slicing machine may include an output conveyor/classifier system 102 which receives and transports stacks of slices from the stacking conveyor 130.

Figure 2:
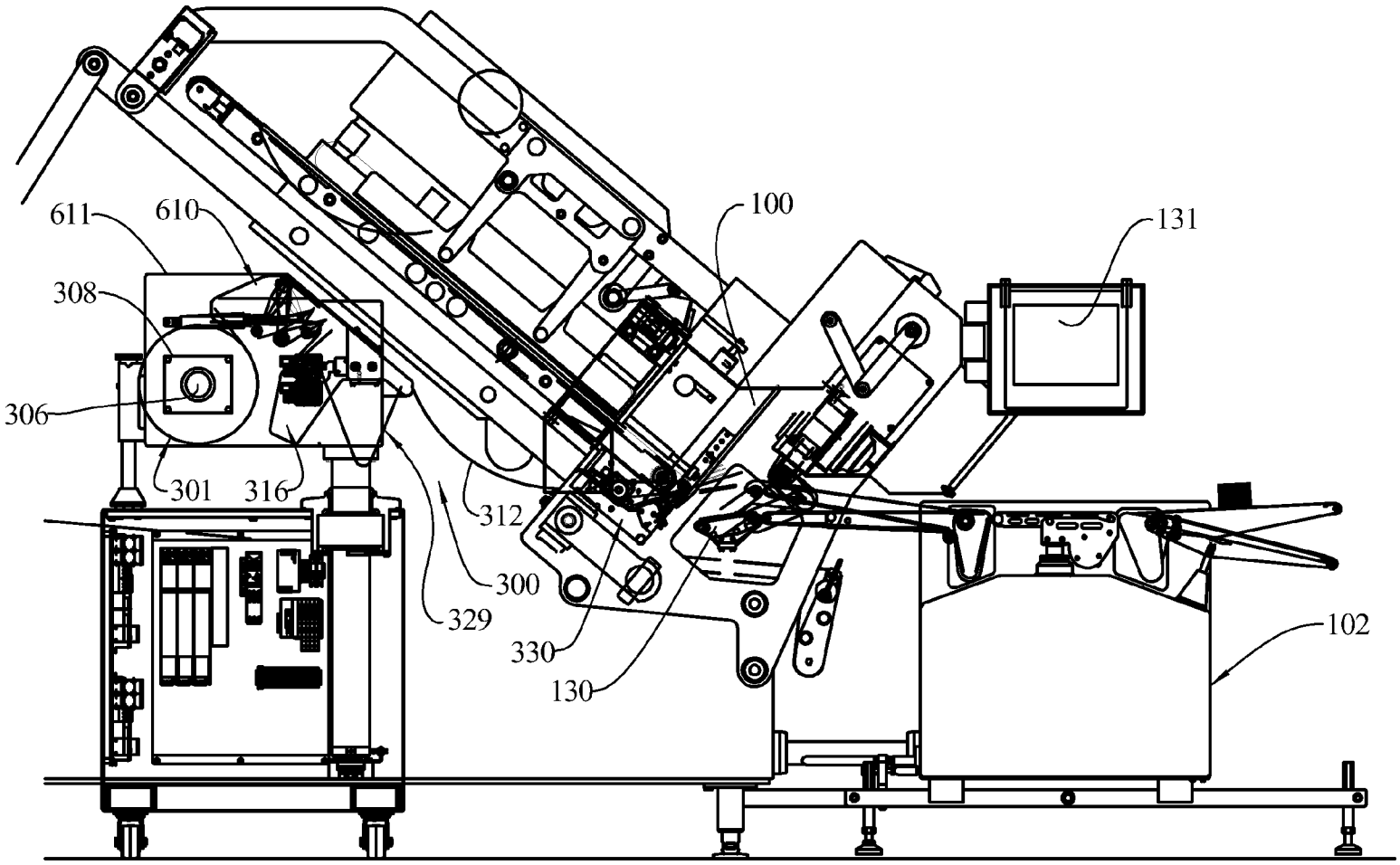
FIG. 2 is an opposite side view of the high-speed slicing apparatus of FIG. 1, incorporating the sheet interleaving mechanism of the present invention.

FIG. 2 illustrates one embodiment of the sheet interleave system 300 of the present invention. For purposes of description, a single sheet interleaving system is described for a slicing machine set up for slicing only one loaf. It should be understood that for a slicing machine that slices two or more side-by-side loaves, multiple sheet interleaving apparatuses 300 can be provided in a corresponding side-by-side arrangement. The sheet interleaving system 300 comprises a web material supply 301, a tension control station 610, a drawing station 316, a web accumulation station 329 and a feed station 330.

Figure 3:
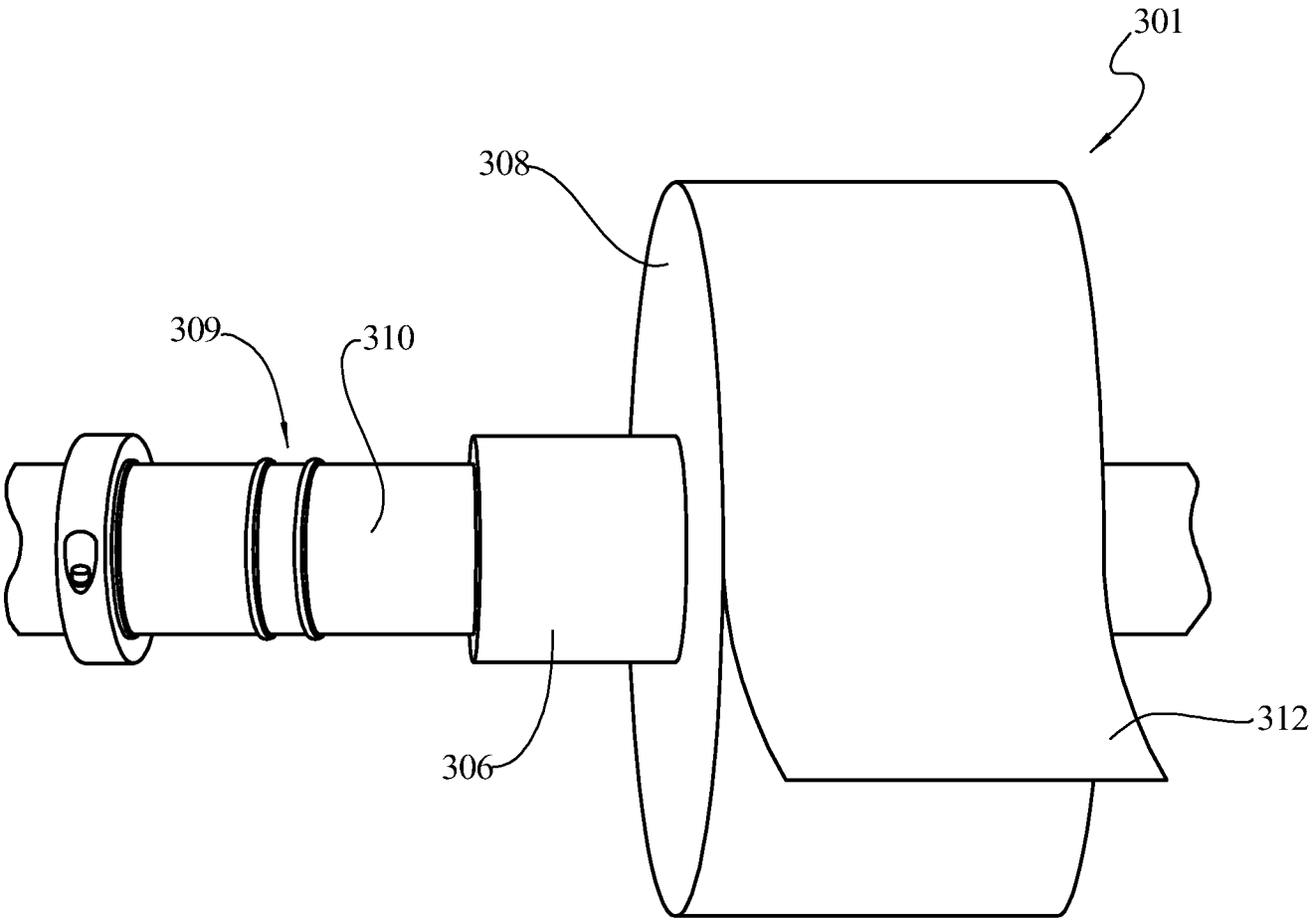
FIG. 3 is a perspective view of one embodiment of the braking mechanism and spool.

The web material supply 301 may be a spool 306 for dispensing web material 312 from a roll 308 as shown in FIG. 3. The spool 306 is supported on a cylindrical shaft 310 that allows the roll 308 to revolve about the shaft 310 to dispense web material 312 (FIGS. 2 and 3). Braking mechanisms 309 are disposed within the shaft 310. The web material 312 extends from the roll 308 and is threaded through a tension control station 610 and then to a drawing station 316. A non-contact sensor, such as an ultrasonic or optical sensor can be used to sense the diameter of the roll 308 and communicates a signal when the roll is depleted, or when the diameter of the roll falls below a pre-selected value.

Figure 4:
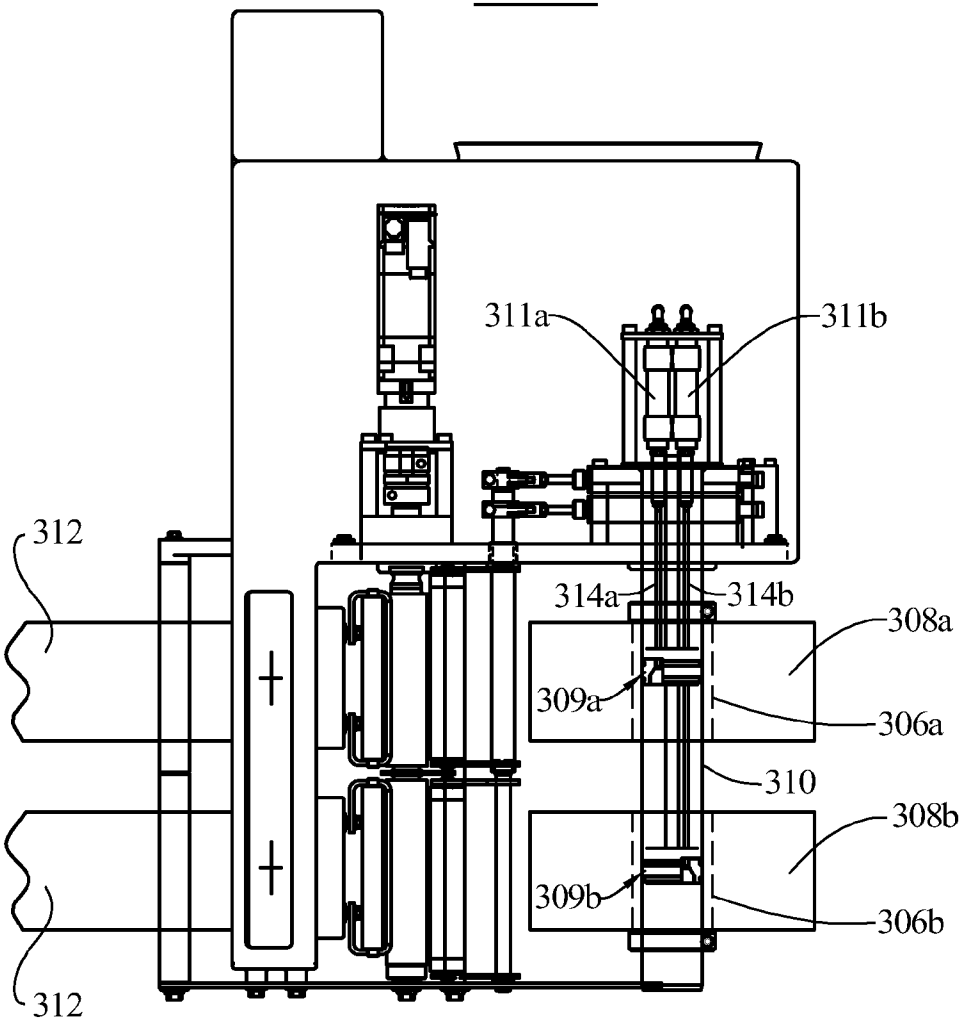
FIG. 4 is a top view of one embodiment of the braking mechanism.

FIG. 4 illustrates a top view of the interleaver system with two rolls 308*a*, 308*b* of material supply. The rolls 308*a*, 308*b* are each on a spool 306*a*, 306*b* supported along the shaft 310 that is in the form of a common cylindrical shaft. Braking mechanisms 309*a*, 309*b* are used to adjust the speed at which web material 312 is dispensed.

Braking mechanism 309 may be a disk, pins, or any other mechanism which can extend from the shaft 310 to generate a frictional force between the cylindrical shaft 310 and the spool 306. In its resting position, the braking mechanism 309 does not protrude beyond the surface of the cylindrical shaft. In its activated position, the braking mechanism 309 extends beyond the cylindrical shaft to a degree which provides the desired amount of frictional force against the spool 306.

Figure 5:
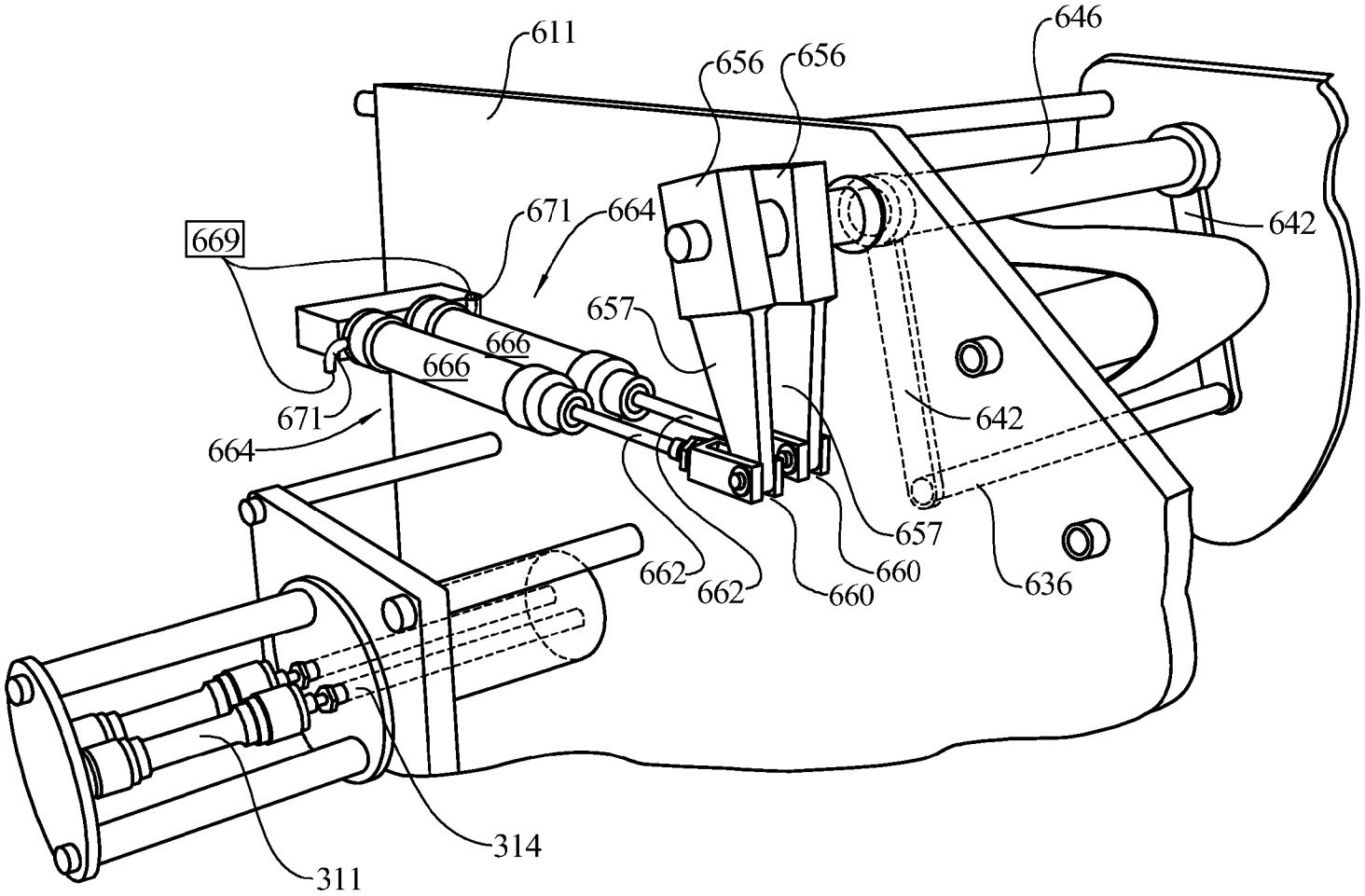
FIG. 5 is a perspective view of the actuators for the braking mechanism and the dancer assembly.

Braking mechanisms 309 are activated using an actuator 311 which is connected to an actuating arm 314. Actuating arm 314 is disposed within the cylindrical shaft 310 (FIG. 5). In operation, as illustrated in FIG. 4, two actuators 311*a*, 311*b* are used to control each of the breaking mechanisms 309*a*, 309*b* to adjust the dispensing rate of rolls 308*a*, 308*b* respectively. The actuators 311*a*, 311*b* are disposed on the same side of the slicing machine. Control for both rolls is made possible by disposing both actuating arms 314*a*, 314*b* within the cylindrical shaft. The first actuating arm 314*a* extends to reach the first braking mechanism 309*a*. The second actuating arm 314*b* extends past the first braking mechanism 309*a* to reach the second braking mechanism 309*b*. A controller signals to the actuator to expand or contract to activate or withdraw, respectively, the braking mechanism. An extension of the actuating arm can be used to cause the braking mechanism 309 to protrude from the cylindrical shaft 310.

Figure 5A:
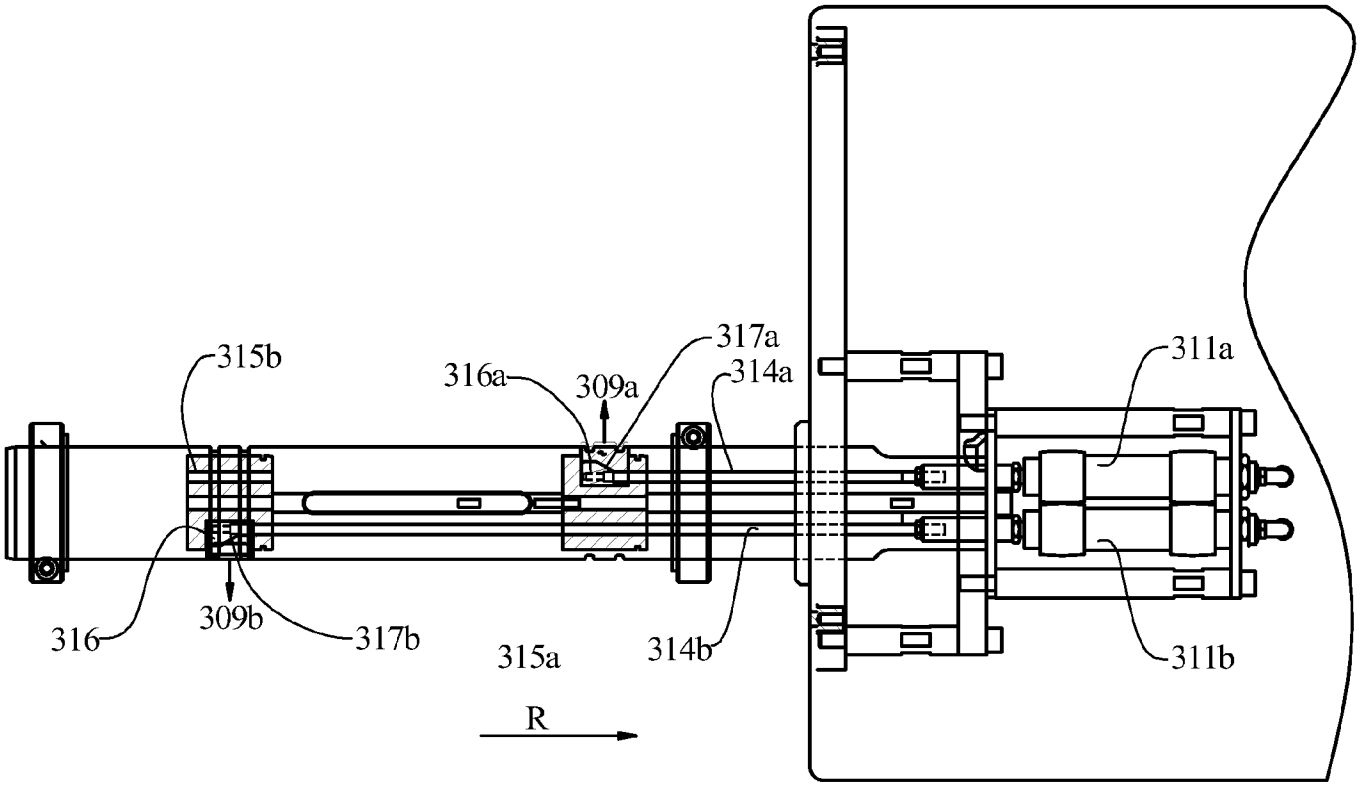
FIG. 5A is an enlarged top view of one embodiment of the braking mechanism.
Figure 5B:
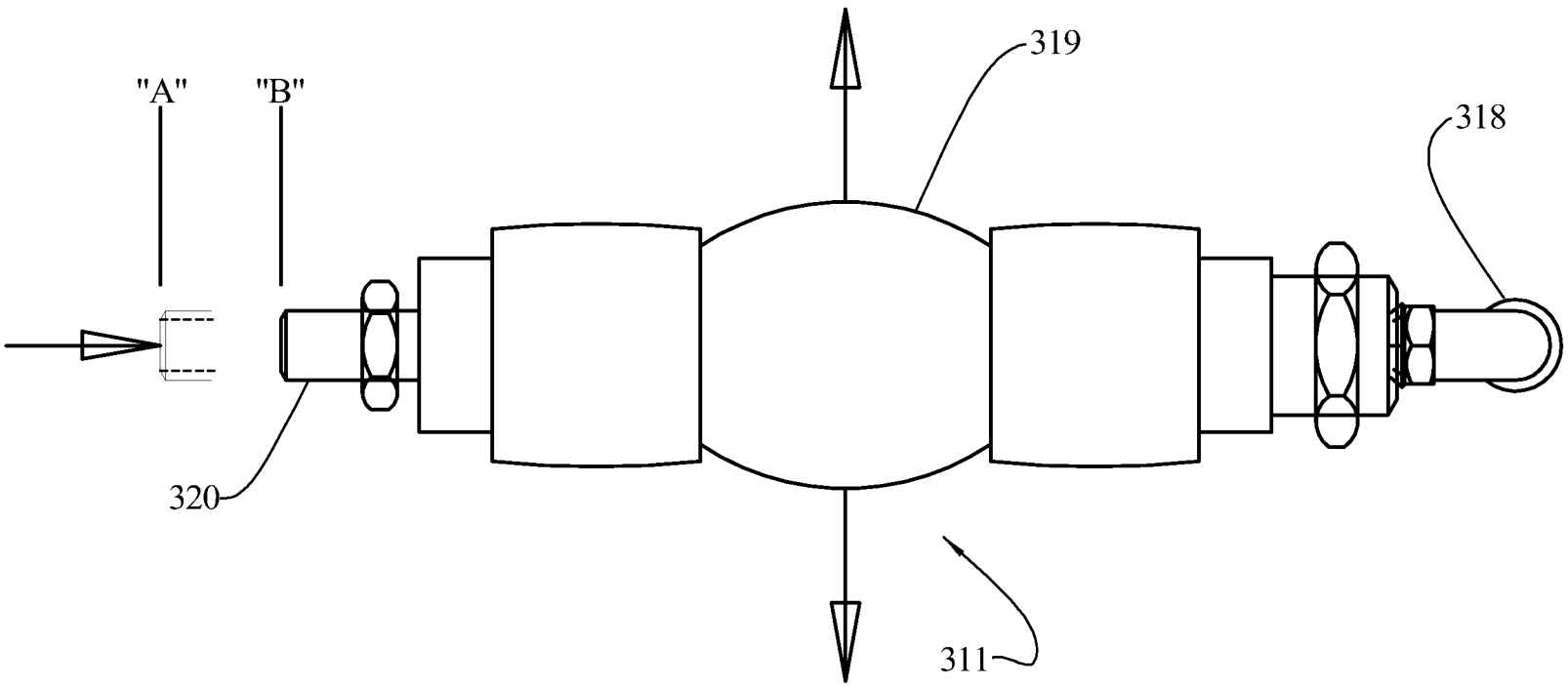
FIG. 5B is a side view of the actuator for the braking mechanism.

In one embodiment, as illustrated in FIG. 5A, braking mechanism 309 is a brake pad 309*a*, 309*b*. Actuating arms 314*a*, 314*b* extend and terminate at braking blocks 315*a*, 315*b* respectively. Braking blocks comprise action blocks 316*a*, 316*b*, and brake pads 309*a*, 309*b*. Action blocks 316*a*, 316*b* are shaped with an inclined surface 317*a*, 317*b* such that brake pads 309*a*, 309*b*, with a complementary shaped surface, can slide over the inclined surface 317*a*, 317*b*. When the actuating arms 314*a*, 314*b* contract, the actuating arms retract in a direction R, pulling the action blocks 316*a*, 316*b* in the same direction. The movement of the action blocks pushes the brake pads outward to generate a frictional braking force which creates drag to stop the roll completely, or causes the roll to pay out the film at a slower pace. Movement of the actuating arms is controlled by the actuator 311, illustrated in FIG. 5B. The actuator 311 comprises a bladder 319, an air pressure inlet 318, and a threaded shaft 320. The threaded shaft 320 extends from one end of the bladder 319 and is connected to the actuating rods. The air pressure inlet 318 is disposed on the opposite end of the bladder. As air pressure is increased, the bladder expands vertically or contracts to pull the threaded shaft from point "A" to point "B" proportional to the amount of air pressure applied. The actuator can be FLUIDIC MUSCLE DMSP, MAS such as those available from Festo Corporation in Hauppauge, N.Y.

Figure 6:
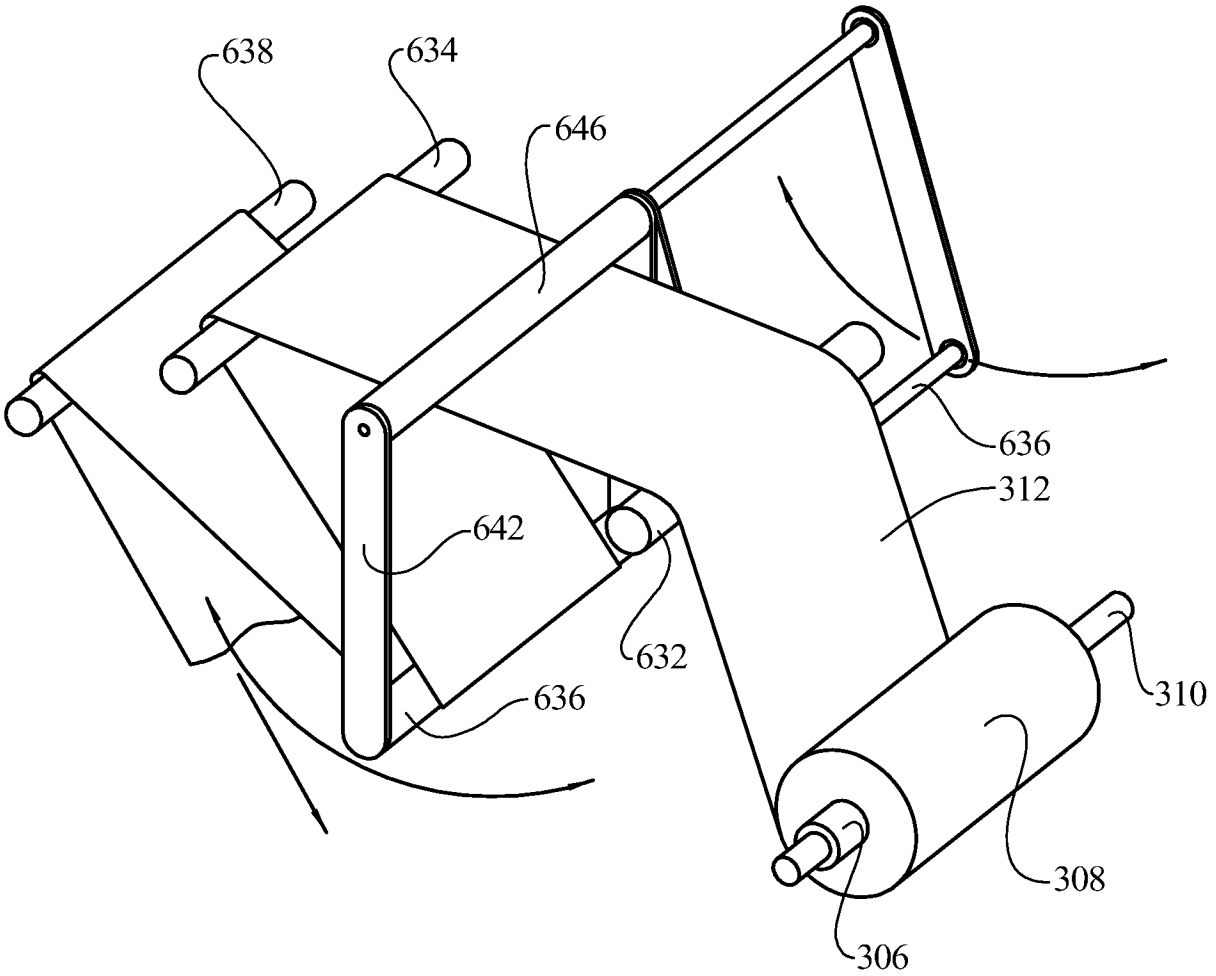
FIG. 6 is a perspective view of the web material threaded through the tension control station.
Figure 7:
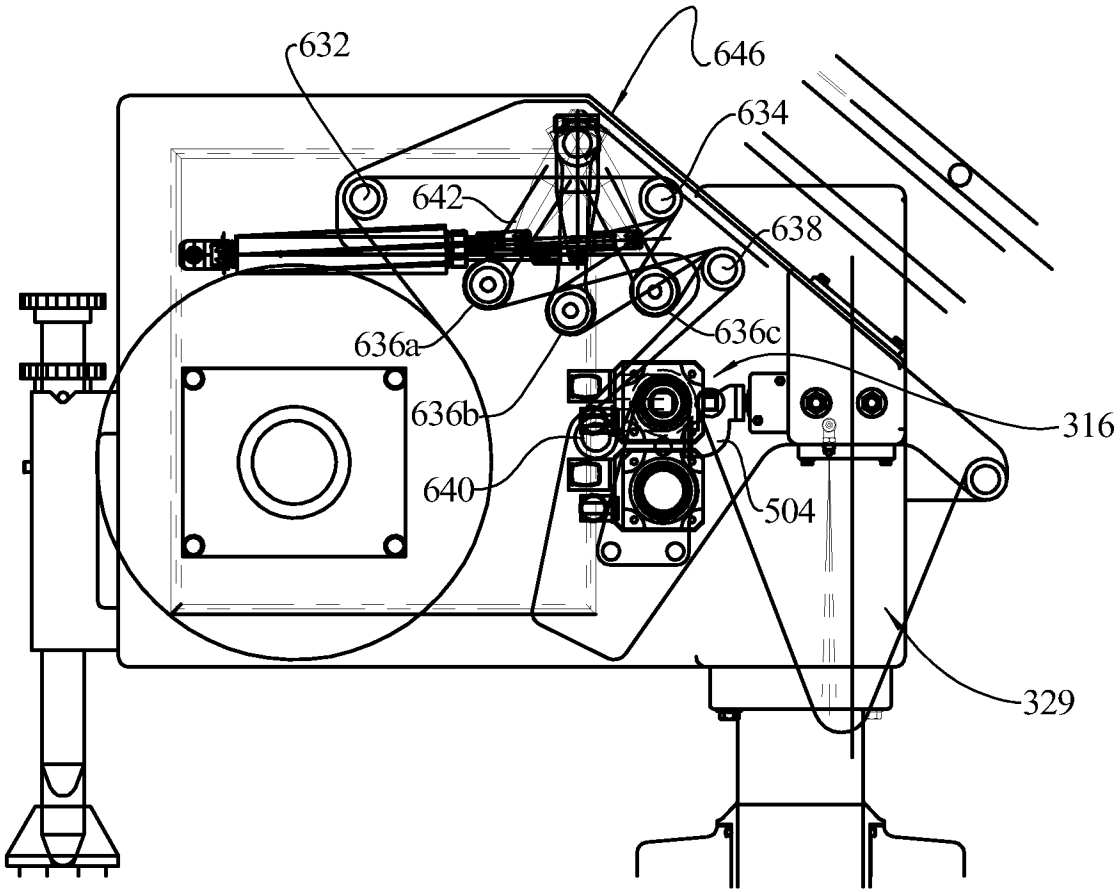
FIG. 7 is a side view of the web supply, the tension control station, and the drawing station.

The web material 312 extends from the roll 308 and is threaded through a tension control station 610 as illustrated in FIGS. 2 and 6. The station 610 includes a housing or frame 611. The web material 312 is first threaded across a first fixed upper idle roller 632 and a second fixed upper idle roller 634 (FIGS. 6 and 7). The web material 312 is then directed downward to wrap a dancer roller 636 and then directed upward to wrap a first lower fixed idle roller 638. The web material 312 is then directed downward to wrap a second lower fixed idle roller 640 and then directed upwards to feed station 330. The dancer roller 636 is mounted across a pair of levers 642 that can be pivoted about by a pivot attachment 646 to the frame 611. A lever arm 656 is clamped and pinned to the lever pivot attachment 646 to rotate therewith. The lever arm 656 includes a tail portion 657 below the attachment 646. The rollers 632, 634, 638, and 640 are all rotatably attached to the frame 611.

Figure 8:
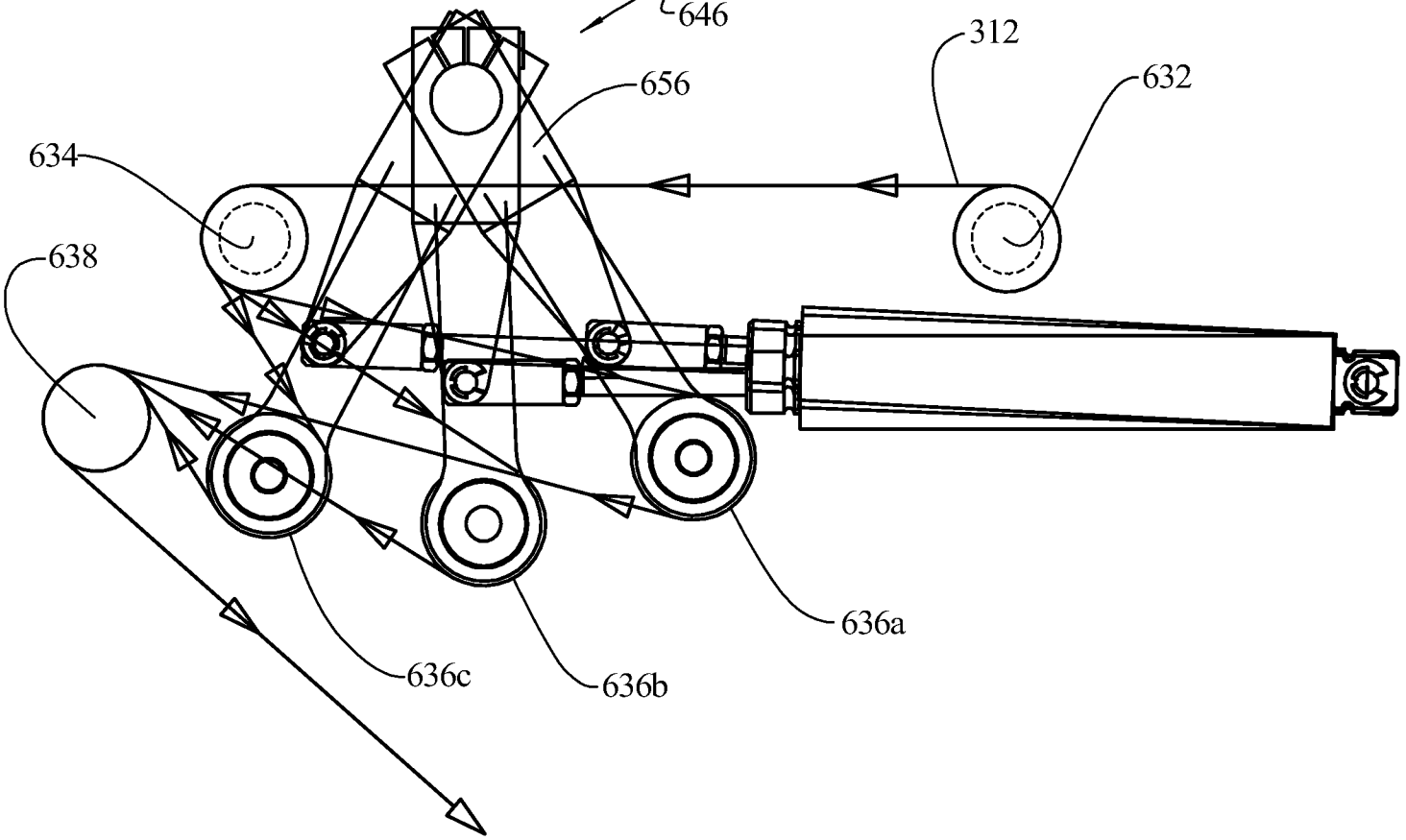
FIG. 8 illustrates the range of motion of the dancer assembly.

As shown in FIG. 5, the lever arm 656 is rotatably attached at connection 660 to an extendable rod 662 of a pneumatic actuator 664. The pneumatic actuator 664 includes a cylinder 666 that is connected to support bar 667 which is attached to the frame 611. A pre-selected pneumatic pressure delivered into the cylinder 666 urges the rod 662 outwardly. Pressurized air is pneumatically connected by a circuit to the cylinder 666. The circuit includes a pressure compensating pressure regulator 669 (shown schematically) which delivers pressurized air into an inlet 671 to maintain a consistent pressure in the pneumatic cylinder 666 regardless of the travel of the rod 662. The air pressure within the cylinder 666 urges the rod 662 to the right in FIG. 5. Given typical surrounding parameters, this pressure can be about 12 psig. The preselected pressure sets the desired tension in the web over the pre-selected range of movement of the arm 656. The arm 656 rotates the pivot attachment 646, which in turn positions the dancer roller 636 to provide the appropriate tension. As illustrated in FIG. 6, dancer rollers 636 may have a range of motion along the circular path illustrated by the arrows. FIGS. 7 and 8 illustrate three positions 636*a*, 636*b*, 636*c* as an example of the range of motion. Shock absorbers (not shown) can be used and engaged by extreme positions of the lever arm 656 or the tail portion 657 to cushion the end of travel of the arm 656 and tail portion 657, resulting in better tension control. Grounding tabs (not shown) can be applied to the idle rollers to minimize static buildup during the feeding of the web material 312 over the rollers. The actuators 664 can be position sensing pneumatic cylinders, such as a POSITION FEEDBACK CYLINDER sold by Bimba Manufacturing Company of Monee, Ill., U.S.

Figure 10:
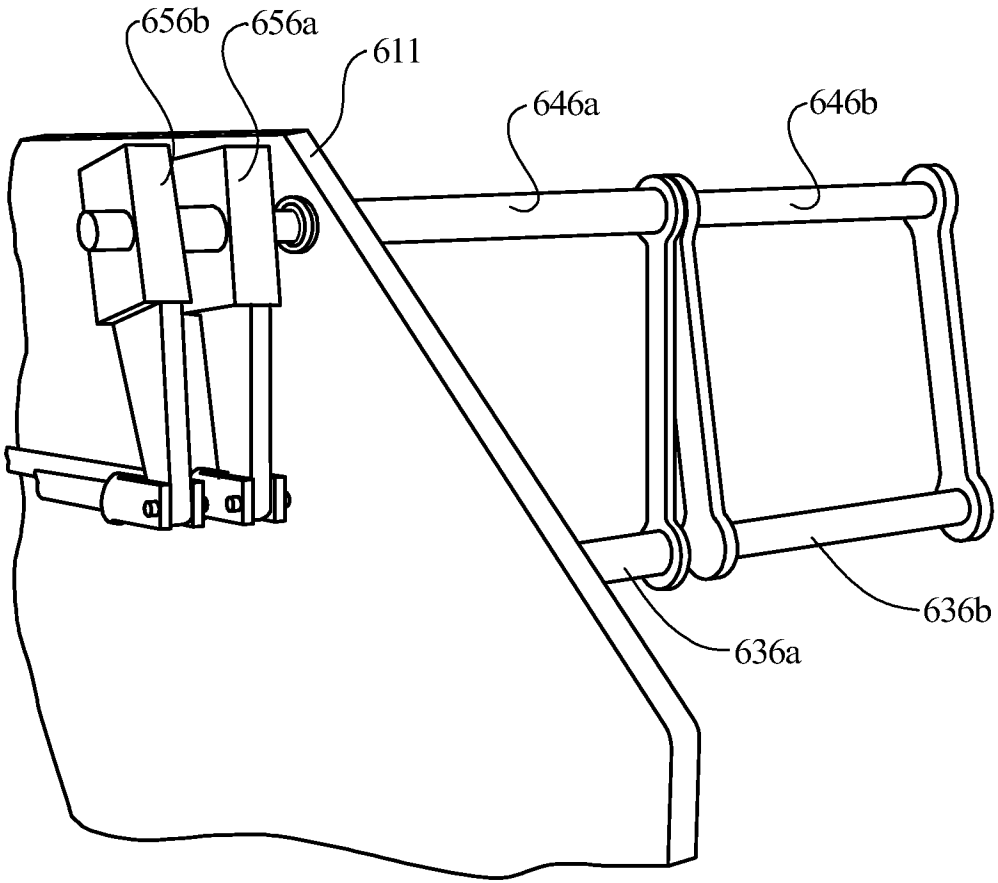
FIG. 10 is a perspective view of the dancer assembly.
Figure 11:
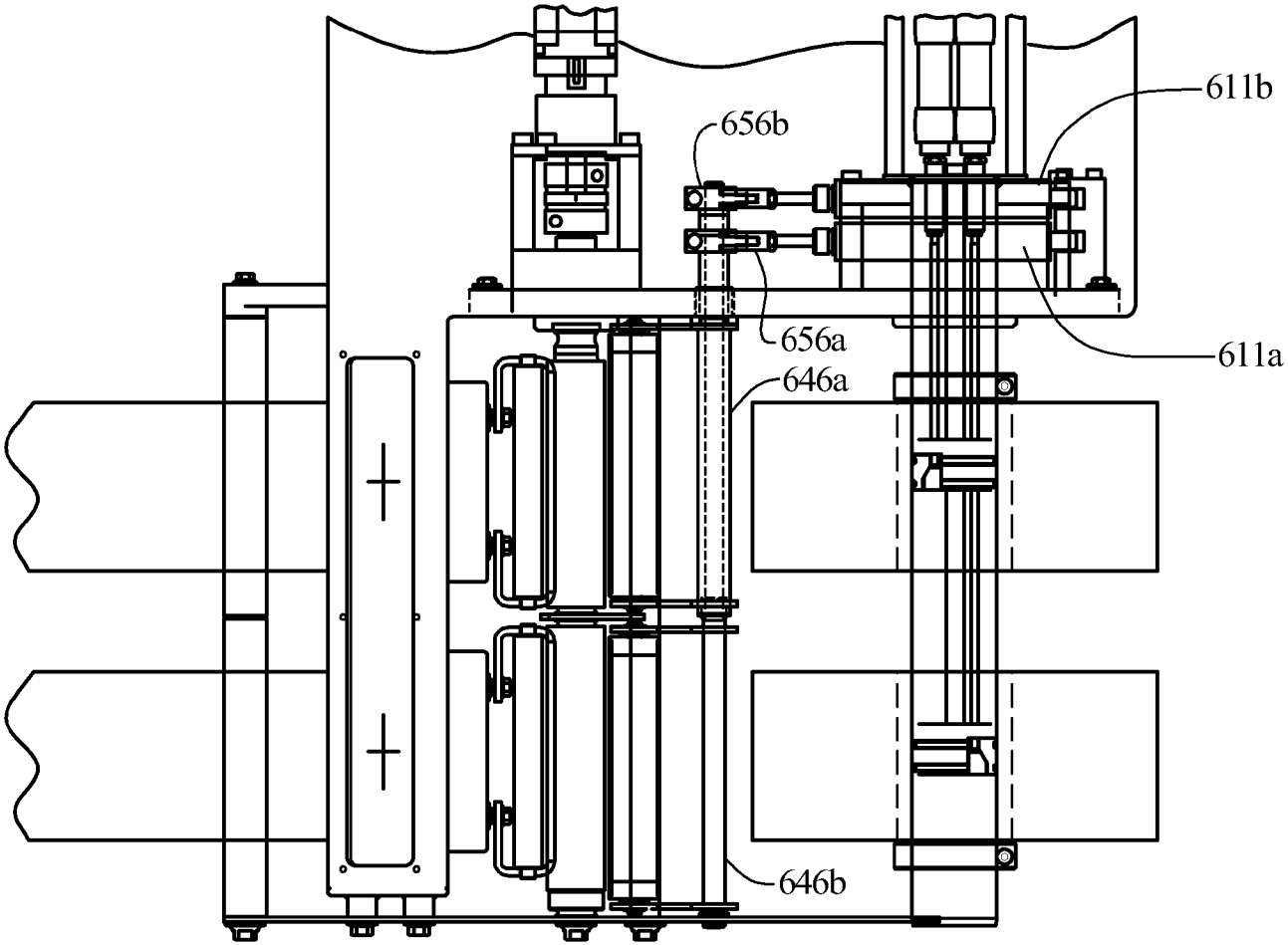
FIG. 11 is a top view of the dancer assembly.

For slicing machines that slice two or more side-by-side loaves, multiple sheet interleaving apparatuses 300 can be provided in a corresponding side-by-side arrangement. A side-by-side arrangement is illustrated in FIGS. 10 and 11, In a side-by-side arrangement, one pivot arrangement extends through the center of the adjacent pivot arrangement. Pivot arrangement 646*b* is a cylindrical shaft with a diameter less than that of pivot arrangement 646*a*, such that pivot arrangement 646*b* can extend coaxially through the cylindrical shaft of pivot arrangement 646*a*. Pivot arrangement 646*a* with pivot arrangement 646*b* disposed within, extends exterior to the frame to connect with lever arms 656*a*, 656*b*. Pivot arrangement 646*a* extends at least up to lever arm 656*a*. Lever arm 656*a* engages with pivot arrangement 646*a* to move corresponding dancer roller 636*a*. Pivot arrangement 646*b* extends from pivot arrangement 646*b* to engage with lever arm 656*b*. Lever arm 656*b* engages with pivot arrangement 646*b* to move corresponding dancer roller 636*b*. The coaxial arrangement allows for multiple sets of actuating mechanisms 611*a*, 611*b* (FIG. 11) to be on the same side of the machinery frame, thus saving space, simplifying wiring and tubing hook up, and providing for easier maintenance.

Figure 12:
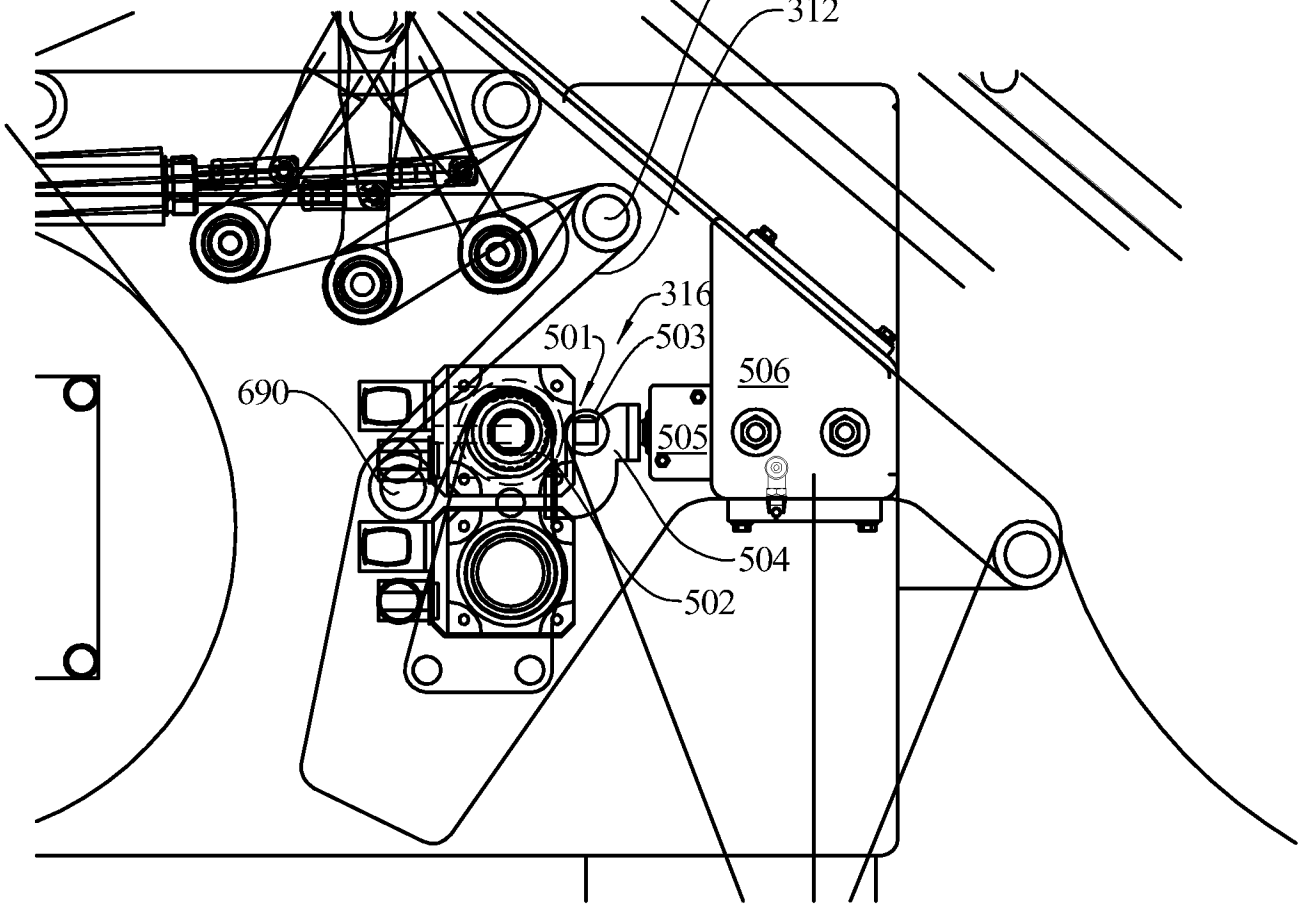
FIG. 12 is a side view of the drawing station.
Figure 13:
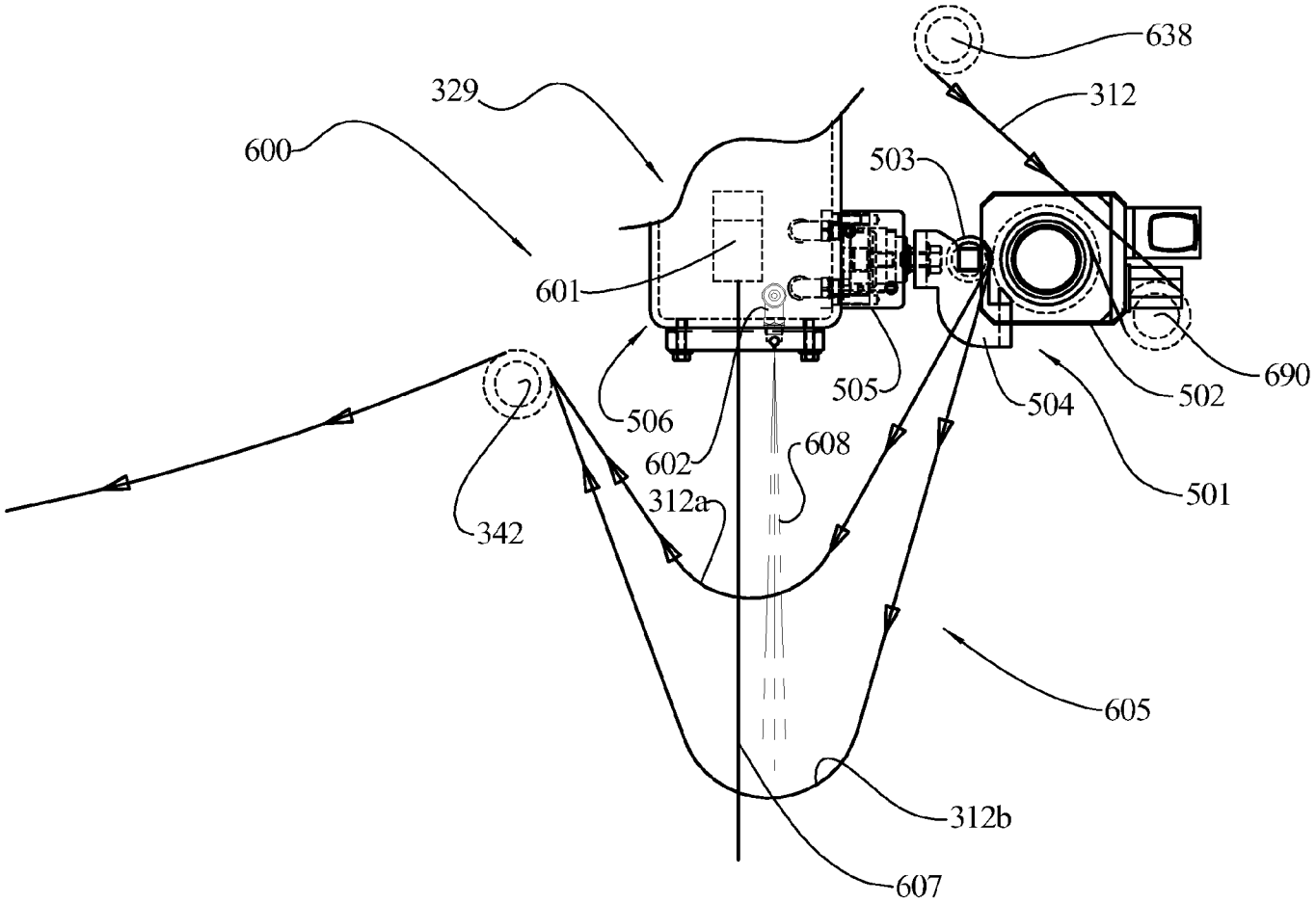
FIG. 13 is a side view of the sensor station.
Figure 15:
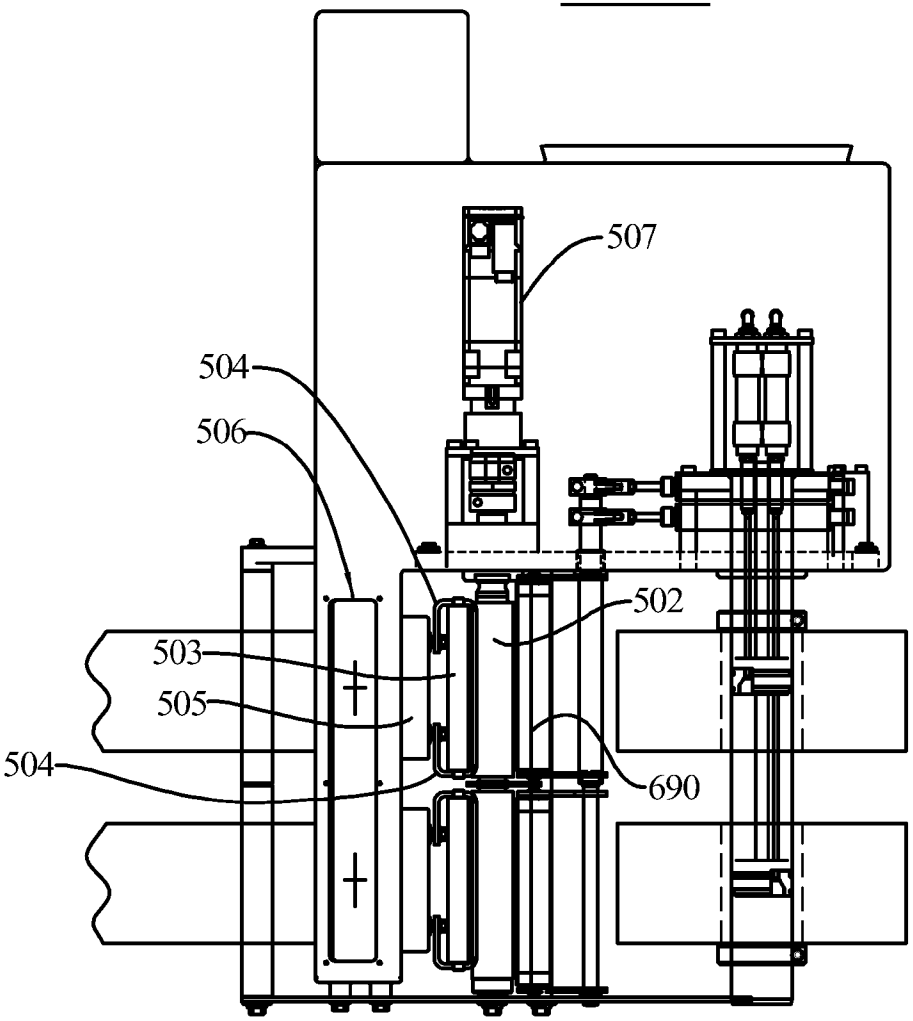
FIG. 15 is a top view of the drawing station.

After being threaded through the tension control station 610, the web material extends into the drawing station 316 before it reaches the sensor station 600. The drawing station is illustrated in FIGS. 12, 13, and 15. The web material 312 entering the drawing station 316 is wrapped around a drawing station fixed idle roller 690. After the fixed idle roller 690, the web material 312 is wrapped around the driven roller 502. Driven roller 502 forms a nip 501 with a nip roller 503. The nip roller 503 is a fixed idle roller disposed against the driven roller 502. Nip roller 503 is held in position using a bracket 504 mounted to a support 505. Support 505 extends from the sensor housing 506.

Figure 15A:
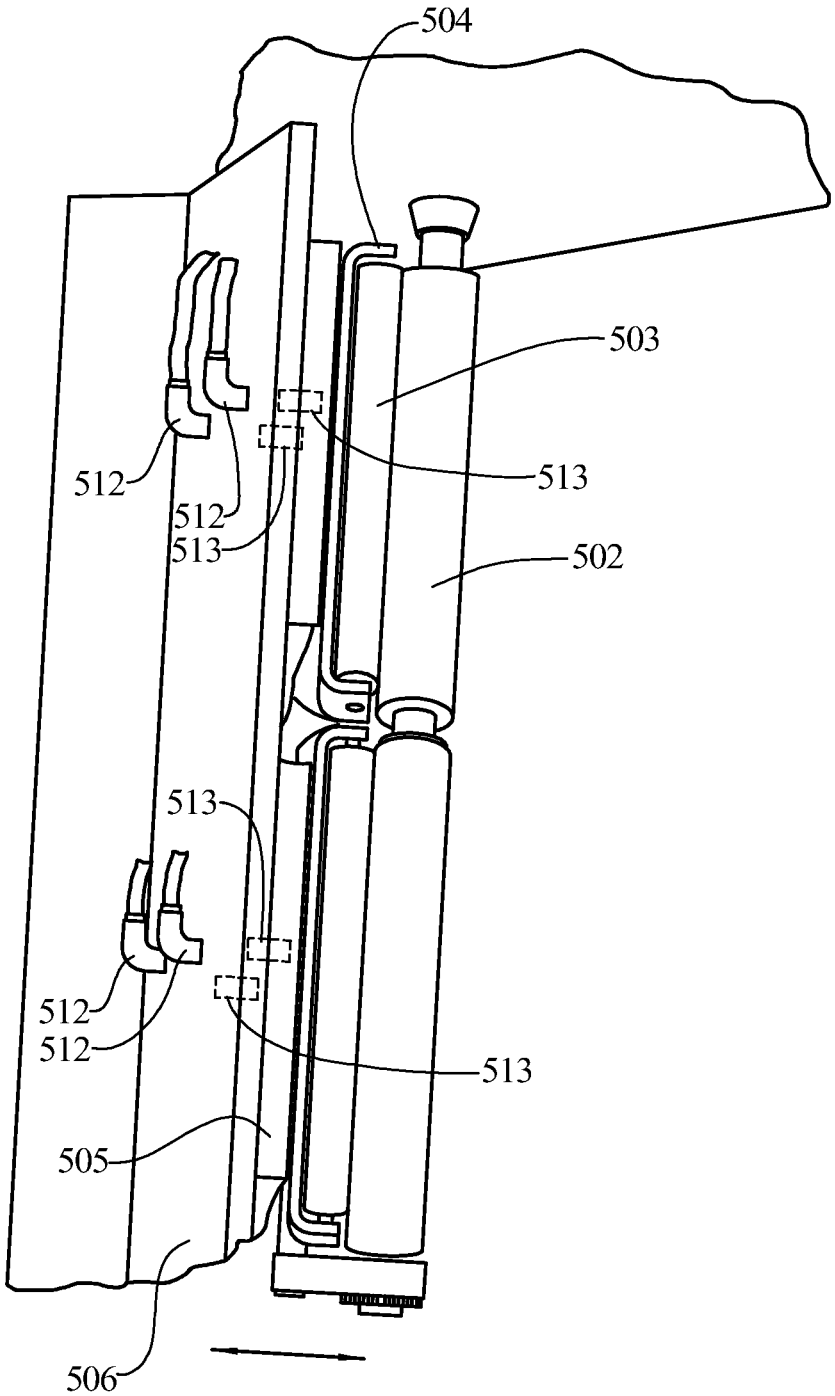
FIG. 15A is a top perspective view of the drawing station rollers.

Bracket 504 extends and retracts horizontally towards and away from the driven roller 502 as illustrated by the double headed arrow in FIG. 15A. The support 505 to which the bracket 504 is mounted, moves towards and away from the sensor housing 506 to move the bracket 504. When the bracket 504 is moved towards the driven roller, a nip is formed therebetween. To remove the roller 503 from contact with the driver roller 502, the support 505 retracts towards the sensor housing 506. The sensor housing comprises air inlets which are connected to an air supply source (not shown). Air entering the inlet is used to operate an actuating mechanism 513 (shown schematically in dashed lines in FIG. 15A). Actuating mechanism 513 can be a pneumatic cylinder with a push rod connected to the sensor housing side of the support. Extension and retraction of the push rod causes the support 505 to retract and extend.

Figure 15B:
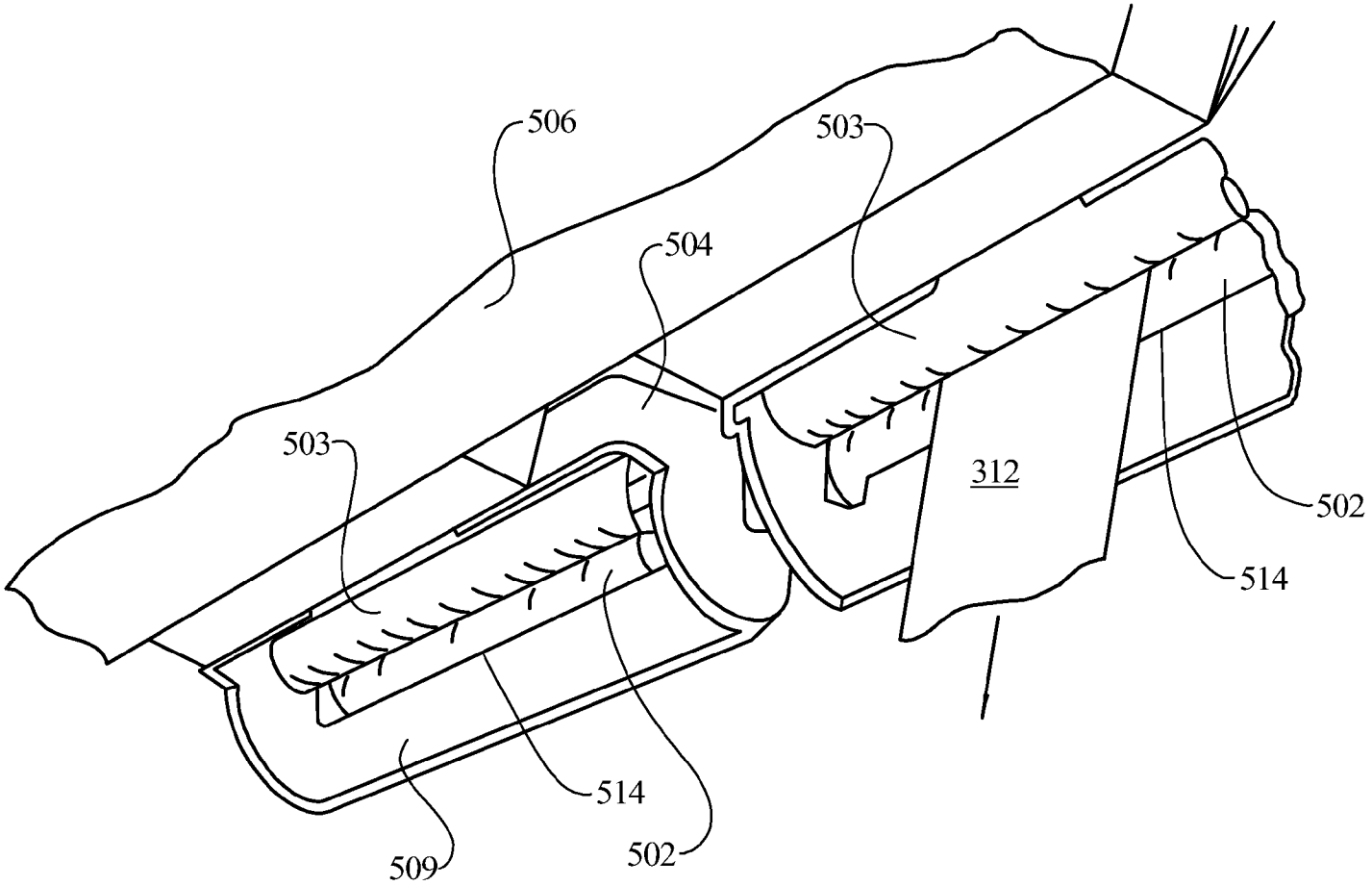
FIG. 15B is a bottom perspective view of the drawing station rollers.

FIGS. 7 and 15B illustrate the bracket 504. The bracket 504 extends below the nip roller 503 on either side of the nip roller 503 to form a lower bar 509. The lower bar 509 has an edge 514 in close proximity to the surface of the driven roller 502. The edge 514 is used to prevent the web material from being wrapped around the driver roller 502 when the web material has a free edge, such as during initial threading of the web material through the interleaving apparatus. The edge 514 of the lower bar 509 of the bracket 504 assists to ensure that web material 312 goes past the two rollers 503, 502 in a downward direction as illustrated by the arrow in FIG. 15B, towards the sensor station 600.

Figure 15C:
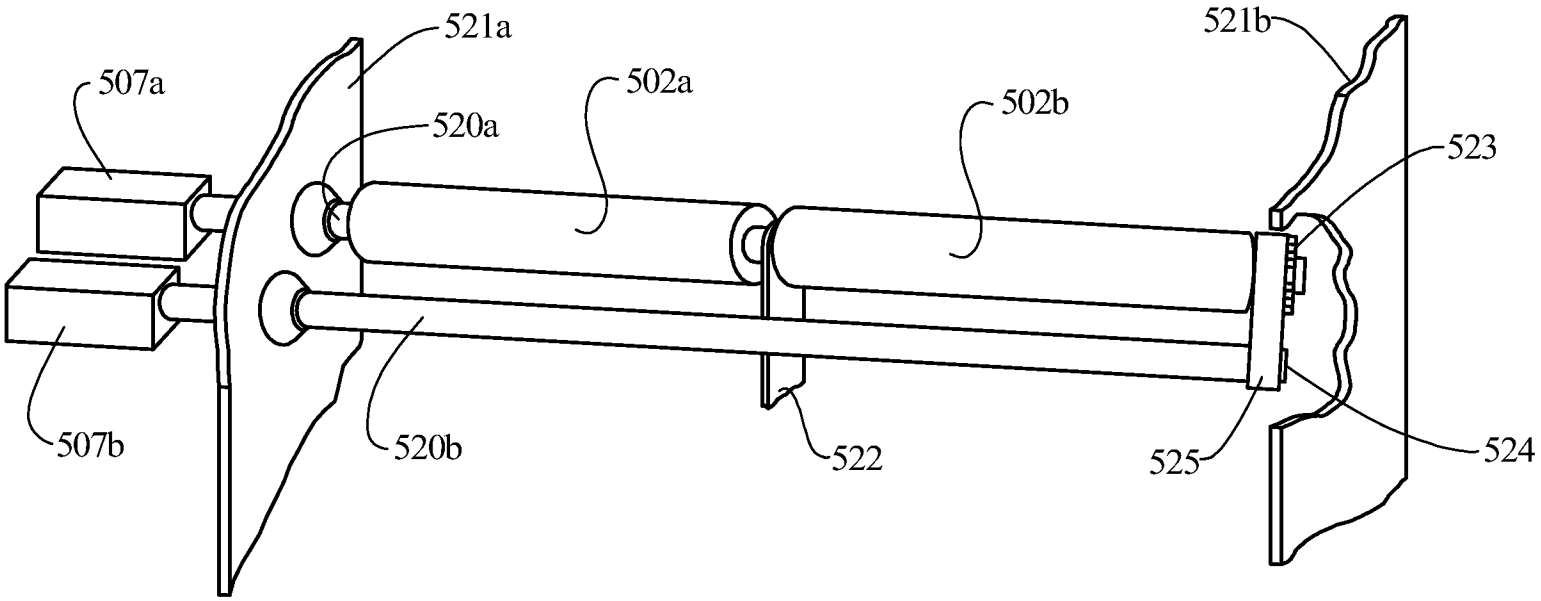
FIG. 15C is a perspective view of motors for driving the drawing station rollers.

Driven roller 502 is driven by a drawing station motor 507. In side-by-side arrangements having more than one driven roller (FIG. 15), a motor 507*a*, 507*b* is used to drive each driven roller 502*a*, 502*b* (FIG. 15C). Driven roller 502*a* is mounted on a shaft 520*a* which spans the length between the two sides 521*a*, 521*b* of the interleaver apparatus frame. Shaft 520*a* is coupled such that only driven roller 502*a* is driven by the rotating motion of the shaft 520*a*. The shaft 520*a* passes through a support 522 and driven roller 502*b*, but does not engage with driven roller 502*b* in a manner that would impart motion to the roller. Driven roller 502*b* is supported in position by the support 522 and by connection to side 521*b* of the interleaver apparatus frame, thus allowing driven roller 502*b* to be suspended above shaft 520*a* without contacting shaft 520*a*. Other configurations for preventing shaft 520*a* from imparting its motion to driven roller 502*b* are also possible. Motor 507*b* drives a shaft 520*b* which imparts its motion to driven roller 502*b* by way of a pair of sprockets 523, 524 joined by a belt or chain 525. Sprocket 524 is disposed on the end of the shaft 502*b* opposite the motor 507*b*, and drives a belt or chain 525. Sprocket 523 is disposed on one end of driven roller 502*b*, such that any motion imparted to the sprocket 523 via the belt or chain 525 drives the drive roller 502*b*. Other suitable arrangements for imparting motion to driven roller 502*b* can be used, such as, for example, the use of a gear train.

The web accumulation station 329, between the nip 501 and an intermediate idle roller 342, provides a length of slackened web material between the high intermittent speed feed station 330 and the constant speed drawing station 316. The accumulation station 329 includes a sensor station 600 that is used to sense the slackness, or accumulation, of the web material 312.

FIG. 13 illustrates the sensor station 600. The sensor station comprises a sensor 601 disposed within the sensor housing, along with an air nozzle 602. The sensor 601 can be an ultrasonic sensor, an optical sensor, such as a laser or photo eye, or other type of sensor. The sensor can be a GV SERIES DIGITAL CMOS LASER SENSOR such as those sold by Keyence Corporation.

The sensor 601 can project an ultrasonic or optical beam signal downwardly toward the web loop 605 formed between the two rollers 342, 502. As illustrated in FIG. 13, the sensor 601 is a laser distance transmitter which generates a laser distance sensor beam 607. The sensor beam 607 measures the web material's lowest position. The sensor 601 communicates with a control which is in signal communication with the drawing station motor 507. For example, web position 312*a* has less web accumulation than web position 312*b*. If the slackness approaches the condition 312*a*, the drawing station motor 507 can be increased in speed to unwind material at a greater ate. If the slackness condition approaches condition 312*b* the motor 507 can be slowed. To maintain the web loop in a substantial V-shape, steady for sensing purposes, between the drawing station motor 507 and the feed station motor 360, a stream of air 608 from the air nozzle 602 is directed downwards within the web material 312.

Figure 13A:
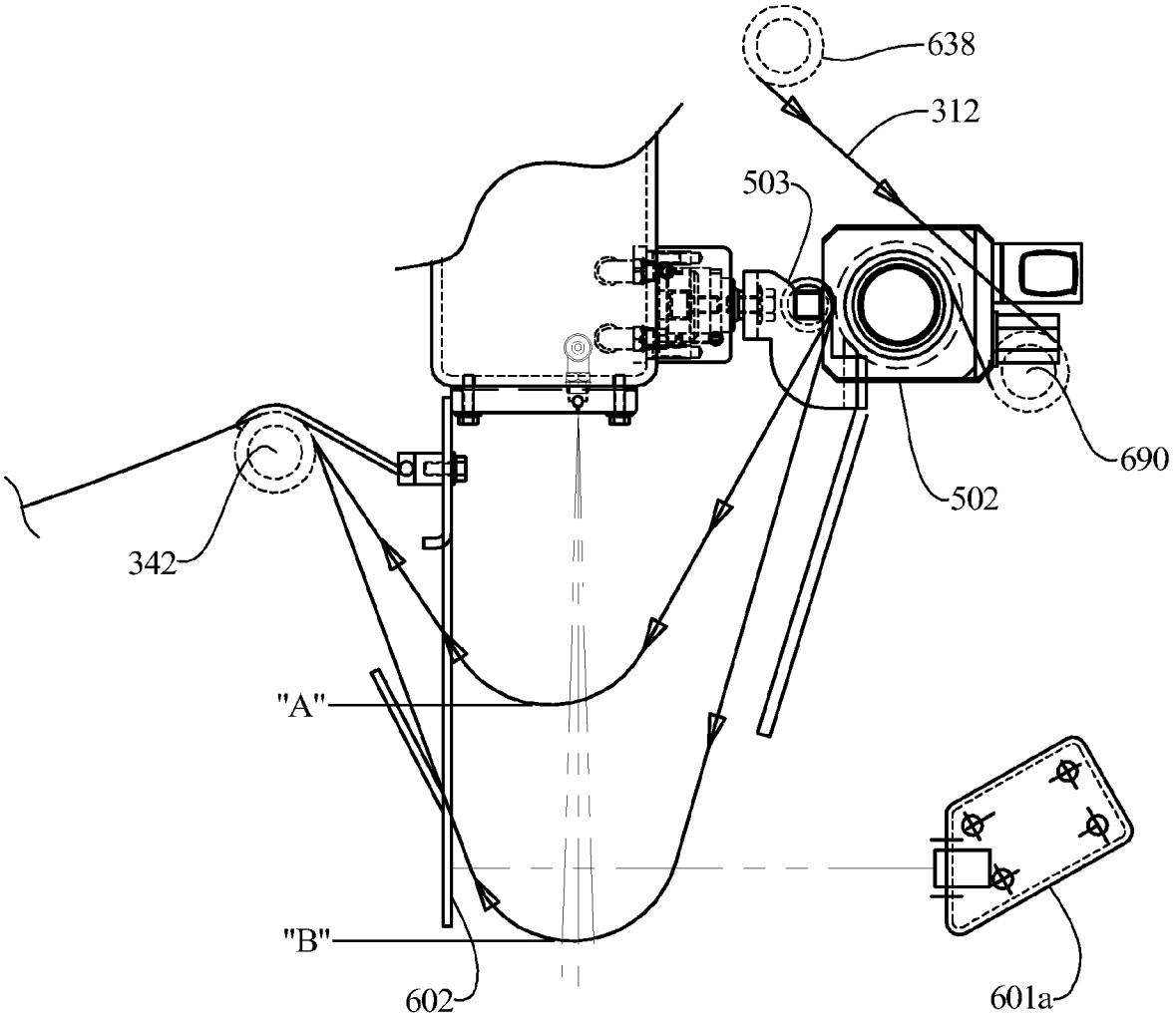
FIG. 13A is an alternate embodiment of accumulation station
Figure 14:
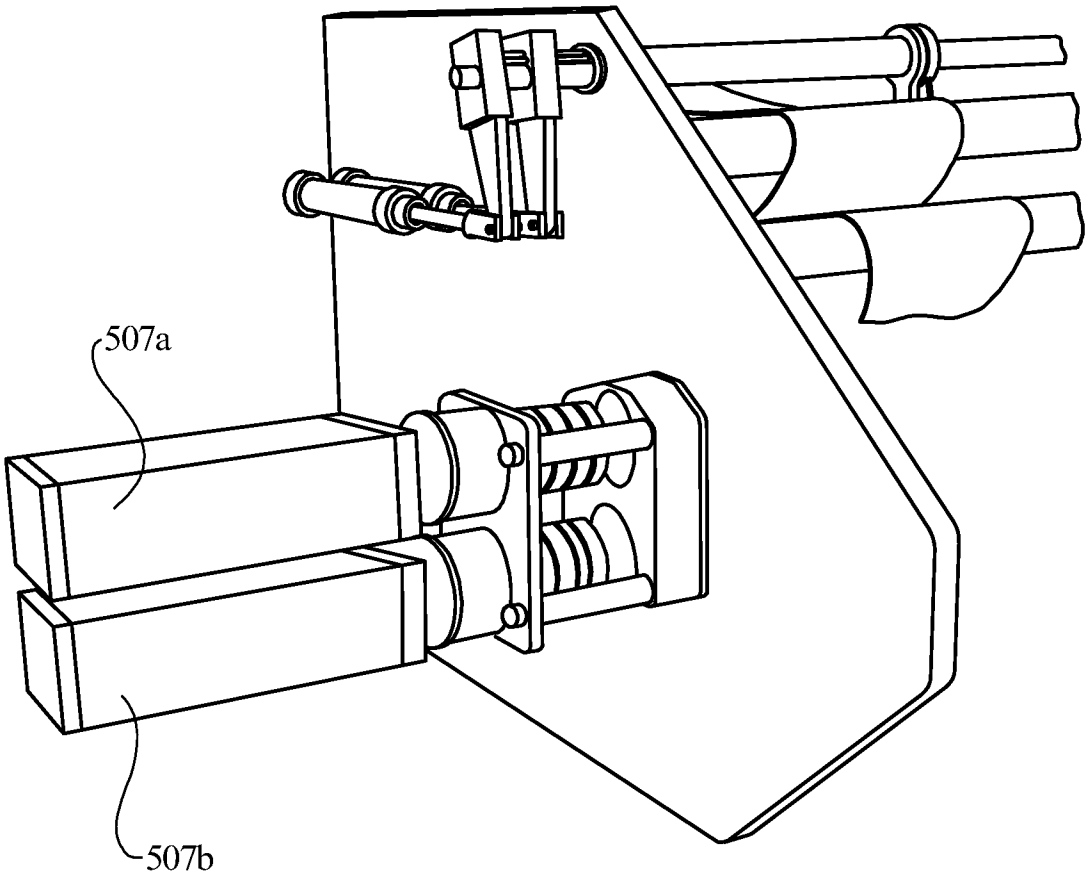
FIG. 14 is a perspective view of motors which drive the rollers in the drawing station.

FIG. 13A illustrates an alternate embodiment of the accumulation station which uses a reflective photo eye sensor. The same reference designations refer to the same parts as previously discussed. A web accumulation station 329A, between the nip 501 and an intermediate idle roller 342, provides a length of slacked web material between the high intermittent speed feed station 330 and the constant speed drawing station 316. The accumulation station 329 includes a sensor station 600*a* that is used to sense the degree of slackness, or accumulation, of the web material 312.

The sensor station 600*a* comprises a sensor which is a reflective photo eye 601*a* disposed to cast a horizontal beam into the area of accumulation of the web material 312. The photo eye 601*a* is used in conjunction with a reflective surface 602. The photo eye 601*a* and the reflective surface are disposed on opposite sides of the area of accumulation of the web material. The reflective surface is oriented vertically and perpendicular to the path of the beam such that the beam of light contacting the reflective surface will be reflected back to the photo eye sensor. When the length of slacked web material forms a loop with a lowest point above the beam path, such as when the bottom of the loop is in position A, the beam of light from the photo eye to the reflective surface is uninterrupted, and the beam of light is reflected back to the photo eye and sensed. When the length of slacked web material forms a loop of sufficient slackened length so as to form a loop which interrupts the beam path, such as when the bottom of the loop is in position B, no light is reflected back to the photo eye. In the absence of a reflective beam, the driving station motor 507, or the payout motor, is sent a signal to pay out web material at a slower rate. When the beam is reflected back to the sensor, the loop of web material has not accumulated a sufficient length to interrupt the beam path, and the driving station motor 507 is sent a signal to pay out web material at a faster rate. The photo eye can emit any electromagnetic beam, such as an infrared beam. Any other method of sensing the slackness of the web accumulation loop can also be used.

Figure 9:
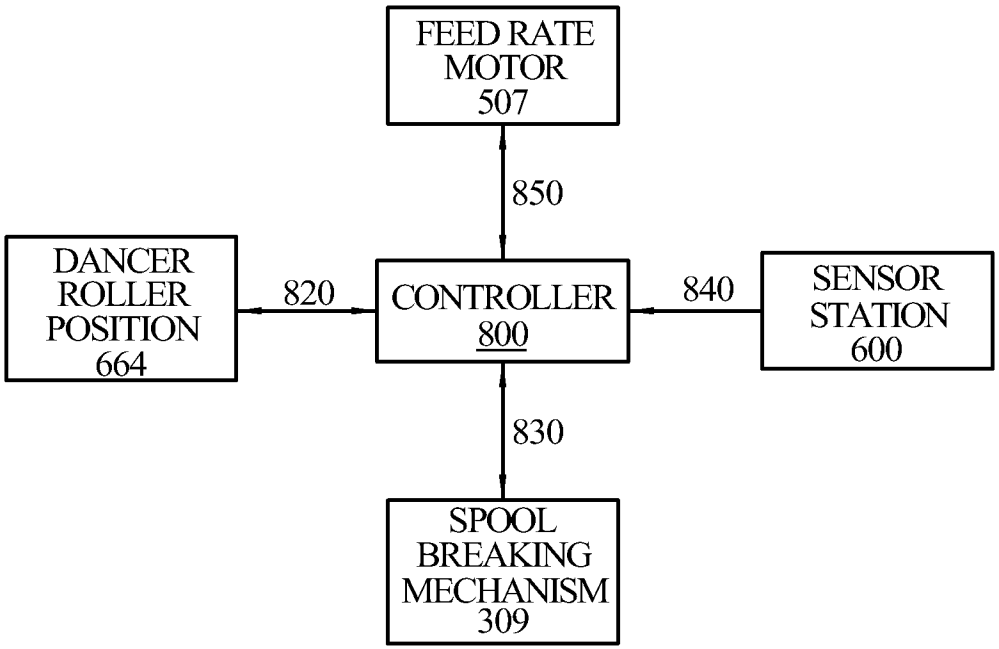
FIG. 9 illustrates one embodiment of a feedback loop system for use with the interleaving mechanism.

FIG. 9 illustrates in schematic form that a controller 800 receives a position signal 820 regarding the position of the dancer roller 636 based on the extension of the actuator rod 662 as a result of the degree of pivot of the pivot attachment 646. The controller sends a signal 830 to the actuator 311 for the braking mechanism of the spool, which allows the controller to adjust the rate the roll 308 is unwound in response to position information of the dancer roller 636. The controller 800 also can receive a signal 840 with the sensor 601 in the sensor station 600 and the feed station motor 850. The sensor 601 detects the slacked length of the web material between the drawing station and the feed station, and communicates the signal 840 to the controller 800. The controller signals the drawing station 301 that more or less web is needed to maintain the slacked length within a desired range. The controller can be a computer 54.

By having a feedback system, the pre-selected level of tension in the interleaver web can be maintained due to the real time communication of positioning information. In one embodiment, the feedback loop may involve only the tension control station and the dispensing of web material from the reel to adjust the slack in the web material.

Figure 16:
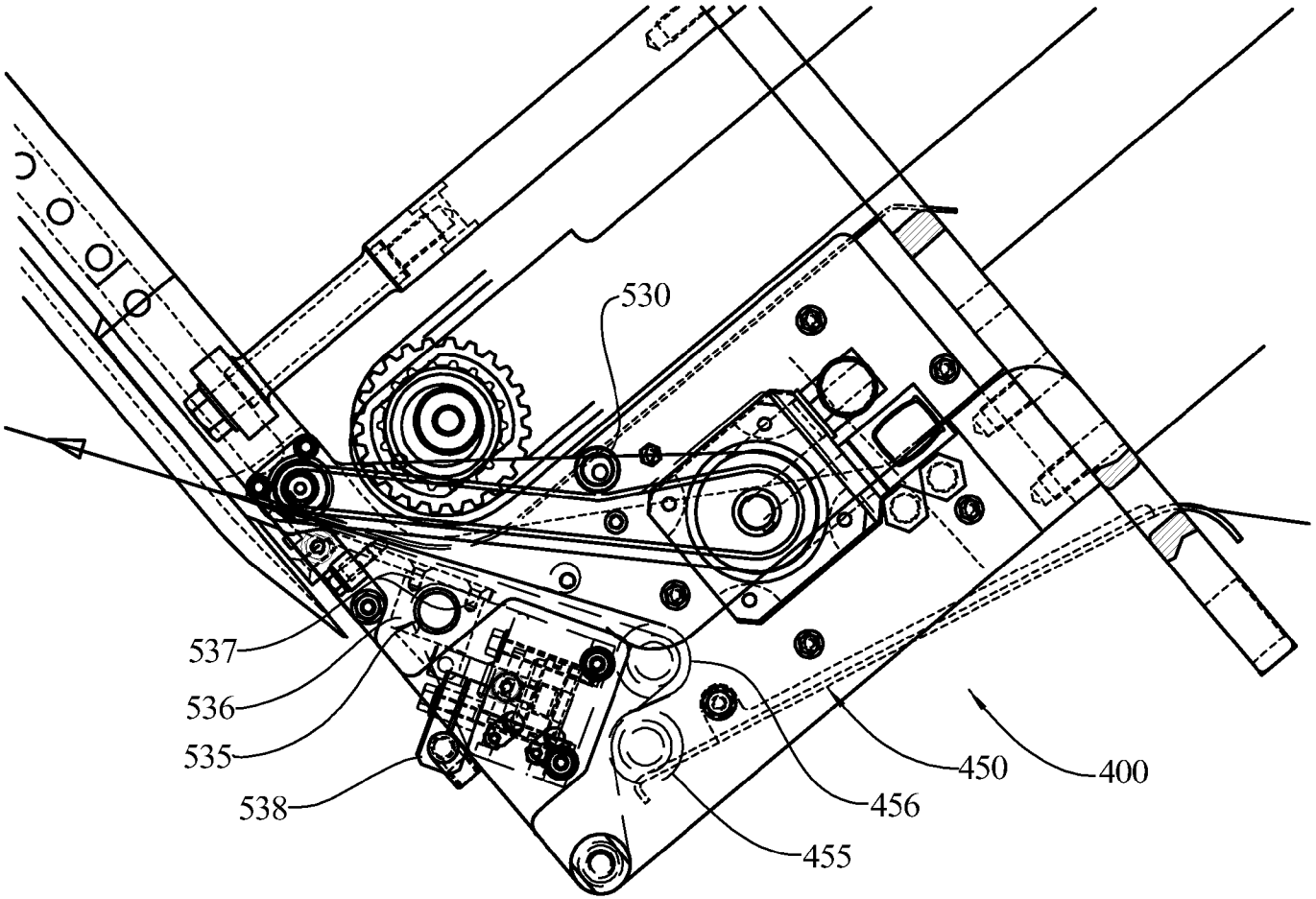
FIG. 16 is a side view of the feed station.
Figure 17:
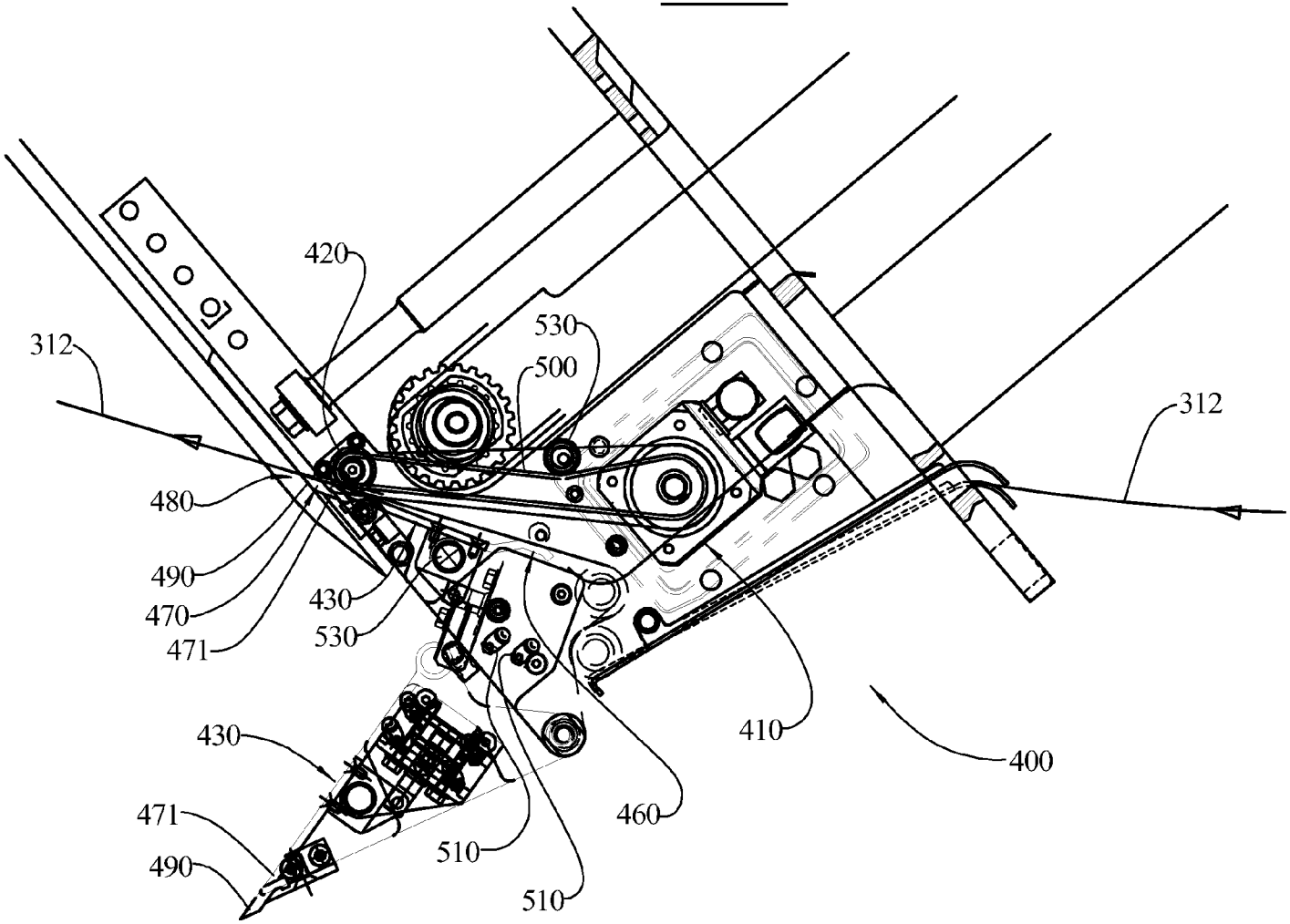
FIG. 17 is a side view of the feed station illustrating the feed station in both its open and closed positions.

After the web material leaves the intermediate roller 342, the web material enters the feed station 400, illustrated in FIGS. 16 and 17. Feed station 400 comprises a feed roller 420 driven by an endless belt 500 connected to a drive motor 410. Idle roller 530 is positioned in contact along the endless belt 500 pathway to provide tension in the endless belt 500.

A nip 470 is formed by the contact of the feed roller 420 and the upward edge 471 of the nip plate device 430. The feed roller 420 can be coated to provide friction at the nip 470. The feed roller 420 may be coated with rubber, or other properties with similar desirable characteristics.

A nip plate device 430 is used to guide the web material 312. Web material 312 glides along the nip plate device 430 towards the nip 470. Nip 470 opens and closes as a result of movement of the nip plate device 430. Nip plate device 430 pivots or tilts about a pivot axis 535. The nip plate device 430 is attached to a support block 536 via a pair of screws 537 (FIG. 16). The pivot axis 535 passes through the support block 536. Movement of the support block 536 about the pivot axis 535 tilts the upward edge 471 of the nip plate device towards and away from the feed roller 420. A counterclockwise rotation of the nip plate device about the pivot axis 535 causes the upward edge 471 to move away from the feed roller 420. A clockwise rotation of the nip plate device 430 about the pivot axis 535 causes the upward edge 471 to move towards the feed roller 420 to create a nip. Pneumatic cylinders 510 (FIG. 17) connected to a coupling 538 (FIG. 16) are used to actuate pivotal movement of the nip plate device 430.

The nip plate device 430 has a raised edge 460 which assists in supporting the web material 312 as it is directed towards the nip 470. Raised edge 460 decreases the slack in the web material 312 in the distance between idle roller 456 and the nip 470. Alternately, the raised edge 460 of the nip plate device 430 can be used to stop the nip plate device 430 from pivoting in a clockwise direction beyond a certain point. The nip plate device 430 comprises a shear edge 490 disposed on the end of the nip plate device opposite the raised edge 460. The shear edge 490 can be made of a plastic or polymeric material. The shear edge 490 forms a cutting nip 480 where the web material 312 is cut.

FIGS. 16 and 17 illustrate the feed station it is closed position (FIG. 16) and both closed and open positions (FIG. 17). The open position allows for the initial threading of the web material through the feed station up to the nip 470 formed between the feed roller 420 and the upward edge 471 of the nip plate device 430, as well as for threading the web material between rollers 455, 456.

As the web 312 enters the feed station 400, a guide plate 450 directs the web material 312 to a pair of idle rollers 455, 456 which assist in maintaining the tension of the web material 312 in the feed station 400 (FIG. 16). After the web material is threaded past the idle rollers 455, 456, the raised edge 460 of the nip plate device 430 guides the web material towards a nip 470 formed between the feed roller 420 and the upward edge 471 of the nip plate device 430.

Figure 18:
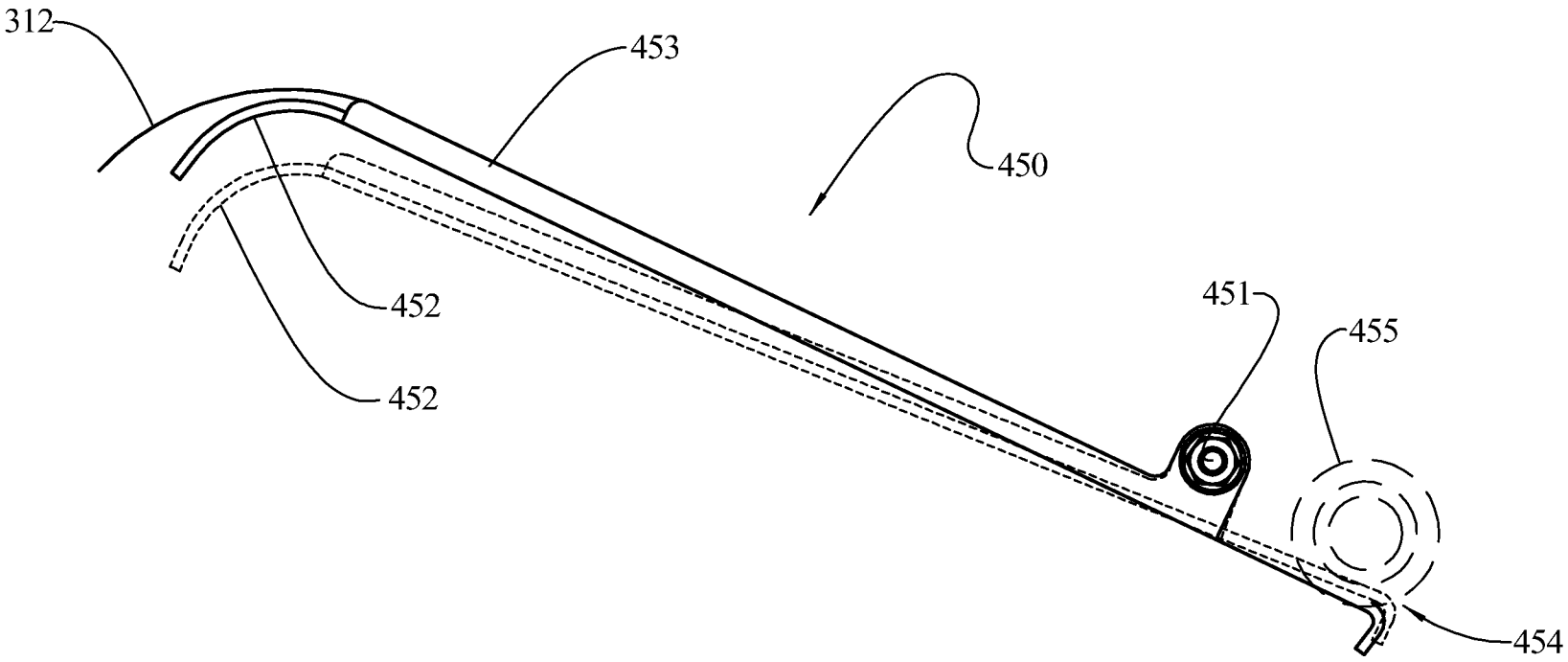
FIG. 18 is an enlarged view of the guide plate.

FIG. 18 illustrates an enlarged view of the guide plate 450. Web material 312 enters the feed station by coming into contact with the guide plate 450. Guide plate 450 has a curved edge 452 to allow better reception of incoming web material 312. The web material glides along the guide plate towards idle roller 455. To prevent the web material from slipping off the guide plate, the guide plate 450 has side rails 453 to keep the web material on the guide plate.

The guide plate 450 is pivotable about a pivot axis 451. The pivot axis is disposed closer to one end of the guide plate than the other. The pivot axis is disposed closer to the end of the guide plate opposite the curved edge. As a result, the curved edge 452 end of the guide plate 450 in its natural state is inclined to tilt downwards due to gravity, towards a position shown in dashed lines in FIG. 18. The natural inclination towards a downwards tilt of the curved edge 452 end causes the opposite end to tilt upwards to form a nip 454 with idle roller 455. The inclination towards forming a nip is useful when initially threading the interleaver apparatus. A user threads the web material 312 from the sensor station 600 towards the guide plate 450. To thread the web material 312 from the guide plate towards the rest of the assembly in the feed station, the user typically moves towards the feed station end of the apparatus to pull the web material 312 from the nip 454. The nip 454 holds the web material 312 until the user reaches the other side of the feed station to pull the web material 312 from the other end. Without the nip 454, the web material may slip off the guide plate. The use of the nip 454 enables one user to thread the machine. When the interleaver apparatus is in motion, the guide plate is pivoted to the position shown in solid lines in FIG. 18, wherein the guide plate 450 is no longer in contact with idle roller 455 to form a nip. This allows web material 312 to pass through the idle roller 455 towards the second idle roller 456.

Figure 19:
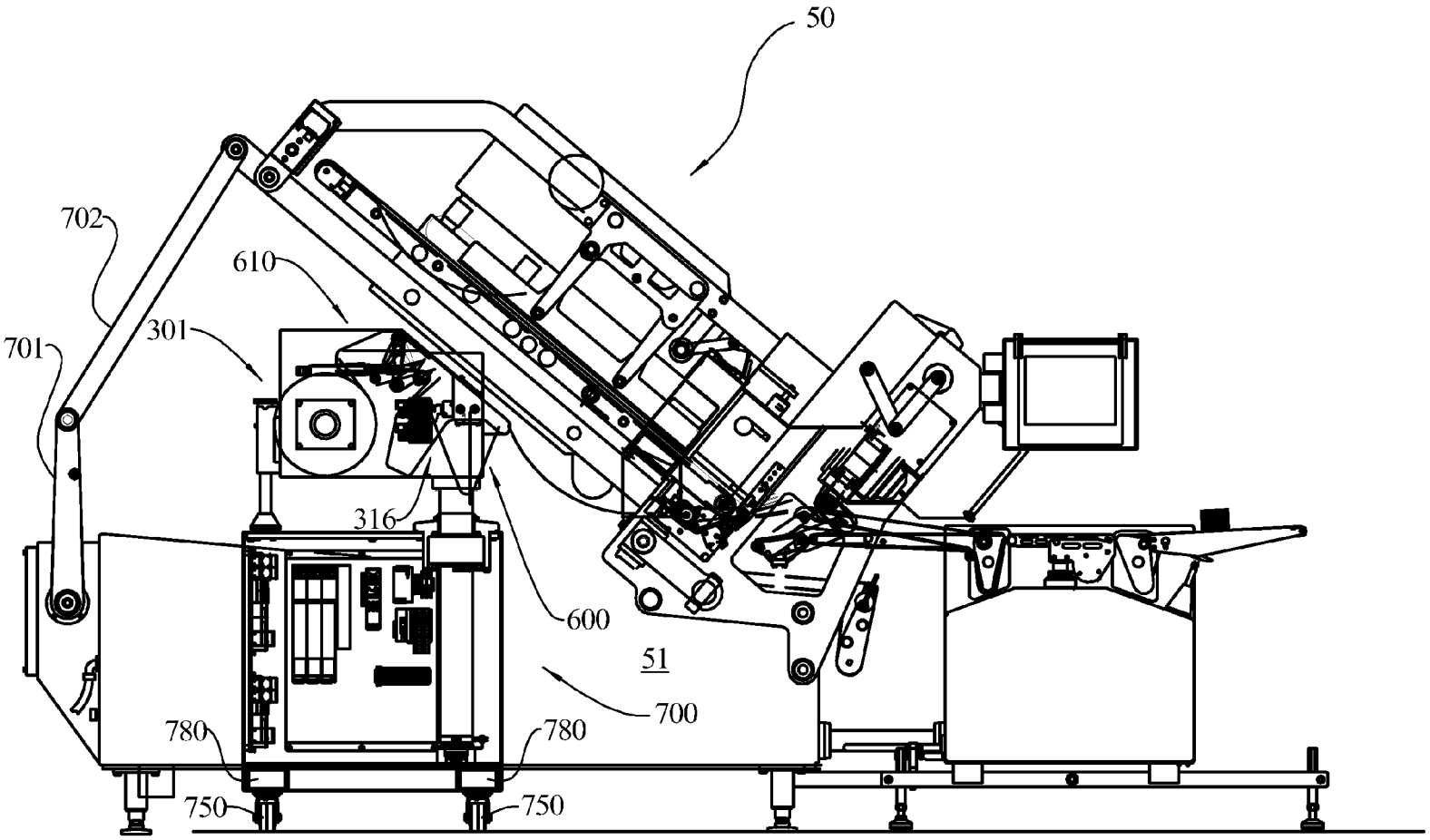
FIG. 19 is a side view of a high-speed slicing apparatus incorporating the sheet interleaving mechanism of the present invention.

FIG. 19 illustrates a side view of the slicer and the interleaver apparatus. The material supply 301, tension control station 610, drawing station 330, and sensor station 600 are all mounted to a moveable frame assembly 700. The slicing machine 50 is connected to pivot arms 701, 702 which allow the slicing machine to move from its raised position (as illustrated in FIG. 19) to a lowered position (not shown) where the slicing machine 50 is more accessible for maintenance and repairs. In its raised position, the material supply 301, tension control station 610, drawing station 316 and sensor station mounted on the moveable frame assembly 700 can fit in the space underneath the raised portion of the slicing machine 50 and above the base 51. When the slicing machine 50 is to be lowered for maintenance or repairs, there is no longer room for the interleaver components to be disposed beneath the slicer machine 50. The moveable frame assembly 700 comprises a lower portion 720 which houses electrical components. The upper portion 730 of the frame assembly comprises a support frame 611 to which components of the tension control station, drawing station, and sensor station are connected.

Figures 20, 21:
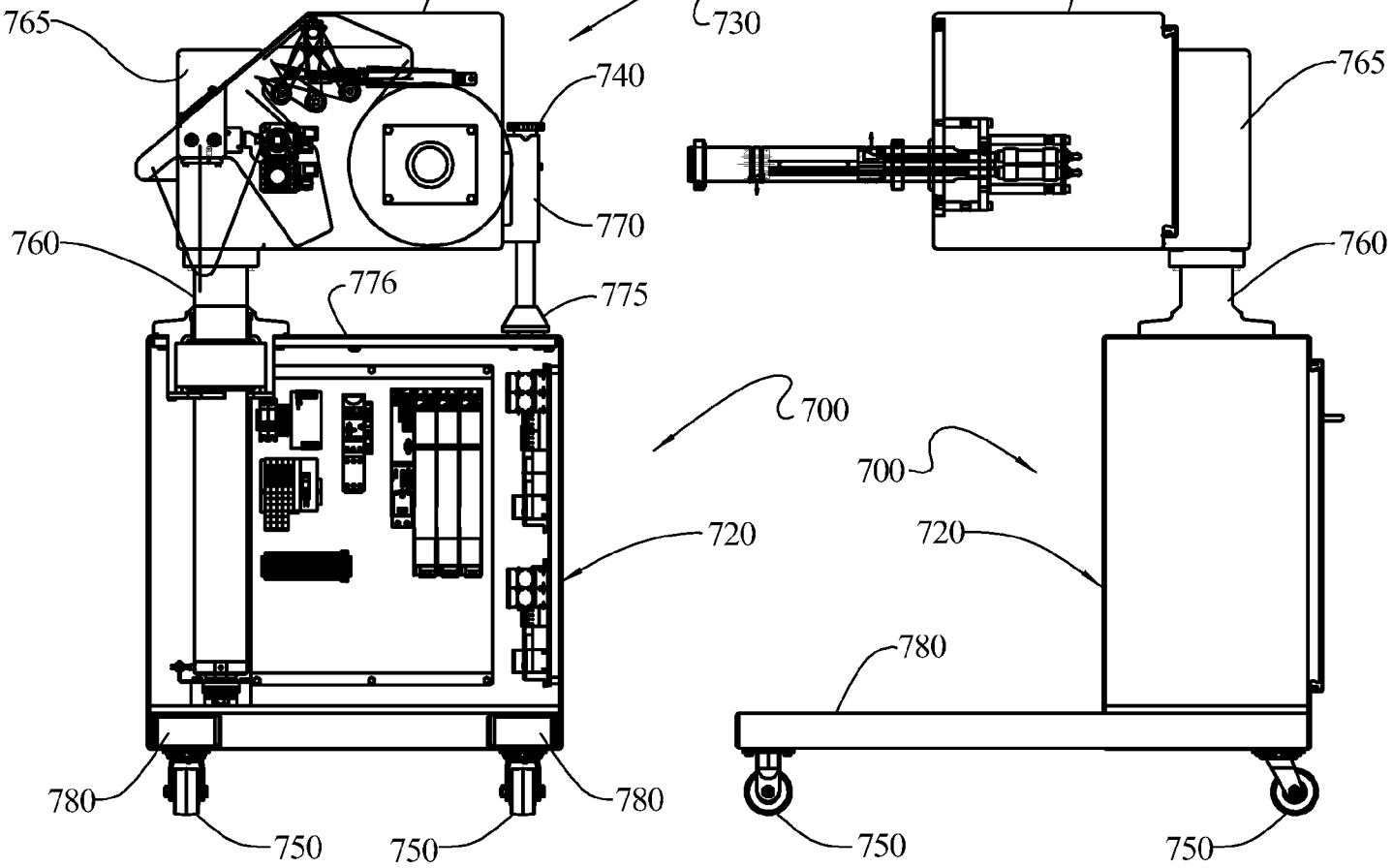
FIG. 20 is a side view of the moveable frame assembly.
FIG. 21 is a front view of the moveable frame assembly.

Support frame 611 is connected to a housing 765 which pivots about a pivot shaft 760 (FIGS. 20 and 21). The pivot shaft connects the upper portion 730 of the frame assembly to the lower portion 720 of the frame assembly. The upper portion 730 of the frame assembly can be pivoted about the pivot shaft 760 while the lower portion 720 of the frame assembly remains stationary. The upper portion 730 can be pivoted about the pivot shaft to allow for easier maintenance of the components within the upper portion 730 of the frame assembly, or to allow at least some lowering of the slicing machine 50. The pivot shaft 760 is a hollow cylinder which can be used as a conduit for the passing of cables and tubes between the upper and lower portions 730, 720.

To ensure that the upper portion 730 of the frame assembly does not inadvertently pivot when movement is not desired, a pin 740 is used to lock the loose end of the upper portion 730 in position. An arm 770 extending from the support frame 611 is a cylindrical shaft through which a pin 740 is passed to lock the frame 611 in place. The pin 740 passes through the cylindrical shaft arm 770 of the housing 611 and is secured to a pin mount 775 connected to the top surface 776 of the lower portion 720. The pin 740 is secured to the pin mount 775 by a threaded coupling. Other methods of securing the frame 611 to prevent unwanted movement about the pivot shaft can also be used.

The upper and lower portions 730, 720 of the frame assembly rest on a pair of forked prongs 780, which provide stability to the moveable frame assembly 700. The forked prongs 780 are of a distance above the floor such that the forked prongs 780 are able to slide underneath the base 51 of the slicing machine 50. By sliding the forked prongs 780 underneath the base 51 of the slicing machine, the frame assembly is able to be positioned dose to the slicing machine. Caster wheels 750 on the underside of the forked prongs 780 allow for the entire assembly to move.

From the foregoing, it will be observed that numerous variations and modifications may be effected without departing from the spirit and scope of the invention. it is to be understood that no limitation with respect to the specific apparatus illustrated herein is intended or should be inferred.

All references, including publications, patent applications, and patents, cited herein are hereby incorporated by reference to the same extent as if each reference were individually and specifically indicated to be incorporated by reference and were set forth in its entirety herein.

The invention claimed is:

1. A sheet interleaver system for a slicing machine having a slicing plane for slicing an elongated food product and for slicing a sheet of web material beneath said elongated product, comprising:

a supply of web material;

a drawing station having a first driver for drawing web material from said supply;

a feed station having a second driver for receiving web material from said drawing station and driving said web material through a cutting nip into said slicing plane;

a first tensioning station between the drawing station and the supply of web material, said first tensioning station exerting a pre-determined tension on the web material, wherein the first tensioning station comprises:

a dancer roller mounted across a pair of levers;

a lever pivot attachment for moving the pair of levers, said levers extending from the pivot attachment; and an actuating mechanism pivotably connected to a lever arm which moves the pivot attachment and the dancer roller across a range of travel; and a second tensioning station adjacent to the first tensioning station, said second tensioning station having a dancer roller mounted across a pair of levers, a lever pivot attachment for moving the pair of levers, said levers extending from the pivot attachment; and wherein the lever pivot attachment of the first tensioning station is a hollow shaft, and wherein the lever pivot attachment of the second tensioning station passes through the hollow lever pivot attachment in a concentric arrangement.

2. The sheet interleaver system of claim 1 wherein the lever arm of the first tensioning station is connected to the lever pivot attachment of the first tensioning station on one end, and is rotatably attached to an extendable rod of the actuating mechanism of the first tensioning station on the opposite end.

3. The sheet interleaver system of claim 2 wherein the extension or retraction of the extendable rod moves the lever and the attached lever pivot attachment of the first tensioning station to move the dancer roller of the first tensioning station across a circular path about the lever pivot attachment of the first tensioning station.

4. The sheet interleaver system of claim 1 wherein the actuating mechanism of the first tensioning station is a pneumatic actuator having an inlet, said actuating mechanism of the first tensioning station comprising a pressure regulator connected to the inlet of the pneumatic actuator to deliver pressurized air into the inlet.

5. The sheet interleaver system of claim 4 wherein the pressure regulator maintains a consistent pressure in the pneumatic actuator.

6. The sheet interleaver system of claim 4, wherein the lever arm of the first tensioning station is connected to the lever pivot attachment of the first tensioning station on one end, and is rotatably attached to an extendable rod of the actuating mechanism of the first tensioning station on the opposite end, and wherein the extension or retraction of the extendable rod moves the lever and the attached lever pivot attachment of the first tensioning station to move the dancer roller of the first tensioning station across a circular path about the lever pivot attachment of the first tensioning station, and wherein the pressure regulator maintains a consistent pressure in the cylinder regardless of the extension of the extendable rod.

7. A sheet interleaver system for a slicing machine having a slicing plane for slicing an elongated food product and for slicing a sheet of web material beneath said elongated product, comprising:

a supply of web material;

a drawing station having a first driver for drawing web material from said supply;

a feed station having a second driver for receiving web material from said drawing station and driving said web material through a cutting nip into said slicing plane;

a tensioning station between the drawing station and the supply of web material, said tensioning station exerting a pre-determined tension on the web material; and a brake mechanism for slowing the supply of web material by exerting a frictional force radially, wherein the supply of web material is on a spool rotatable about a cylindrical shaft, said brake mechanism disposed within the cylindrical shaft; and wherein the brake mechanism includes a brake pad, and wherein the brake mechanism moves between an inactive position wherein the brake pad is flush with the surface of the cylindrical shaft, and an active position wherein the brake pad protrudes from the surface of the cylindrical shaft.

8. The sheet interleaver system of claim 7 wherein the brake mechanism comprises an action block, wherein the action block is connected to a rod of a pneumatic cylinder, wherein the pneumatic cylinder comprises an air pressure bladder, said bladder contracts and expands in proportion to the amount of air pressure supplied to the bladder, and wherein the action block has a contoured surface; and wherein the brake pad has a complementarily contoured surface in contact with the contoured surface of the action block and wherein movement of the action block causes the brake pad to protrude from the surface of the cylindrical shaft.

9. The sheet interleaver system of claim 7 wherein the brake mechanism comprises an action block, wherein the action block is connected to a rod of a pneumatic cylinder, wherein the pneumatic cylinder comprises an air pressure bladder, said bladder contracts and expands in proportion to the amount of air pressure supplied to the bladder, and wherein the movement of the action block across an inclined portion of the brake pad causes the brake pad to protrude from the surface of the cylindrical shaft.

* * * * *